US011471903B2

(12) United States Patent
El Hassain

(10) Patent No.: US 11,471,903 B2
(45) Date of Patent: Oct. 18, 2022

(54) DEVICE FOR PACKAGING A FLUID PRODUCT AND DISPENSING THE PRODUCT IN DOSES, INCLUDING A REUSABLE BOTTLE

(71) Applicant: POCHET, Clichy (FR)

(72) Inventor: Alim El Hassain, Saint Ouen (FR)

(73) Assignee: POCHET, Clichy (FR)

( * ) Notice: Subject to any disclaimer, the term of this patent is extended or adjusted under 35 U.S.C. 154(b) by 0 days.

(21) Appl. No.: 17/311,189

(22) PCT Filed: Nov. 26, 2019

(86) PCT No.: PCT/FR2019/052805
§ 371 (c)(1),
(2) Date: Jun. 4, 2021

(87) PCT Pub. No.: WO2020/115399
PCT Pub. Date: Jun. 11, 2020

(65) Prior Publication Data

US 2022/0023901 A1 Jan. 27, 2022

(30) Foreign Application Priority Data

Dec. 5, 2018 (GA) ..... 18 72394

(51) Int. Cl.
*B05B 11/00* (2006.01)

(52) U.S. Cl.
CPC ..... *B05B 11/3047* (2013.01); *B05B 11/0038* (2018.08); *B05B 11/0054* (2013.01);
(Continued)

(58) Field of Classification Search
CPC ..... B05B 11/3047; B05B 11/0038; B05B 11/00412; B05B 11/00416; B05B 11/0054; B05B 11/3059; B05B 11/0032
(Continued)

(56) References Cited

U.S. PATENT DOCUMENTS 8,267,280 B2 * 9/2012 Kneer ..... B05B 11/3047 222/83
2007/0164049 A1 * 7/2007 Bonney ..... B05B 11/309 222/162

(Continued)

FOREIGN PATENT DOCUMENTS

DE 10 2008 022 595 4/2009
EP 2 153 908 2/2010

(Continued)

OTHER PUBLICATIONS

International Search Report for PCT/FR2019/052805 dated May 25, 2020, 5 pages.

(Continued)

*Primary Examiner* — Vishal Pancholi
(74) *Attorney, Agent, or Firm* — Nixon & Vanderhye

(57) ABSTRACT

The device for packaging and dispensing a product includes a preassembled inner unit mounted in a hollow body, with a dispensing head surrounded by an upper connector which allows removably attaching the body. The inner unit includes a reservoir, and the head sealingly closes the opening of the reservoir. A peripheral retaining ring for the inner unit keeps the reservoir and head integrally secured. The connector is connected to the body by a locking action which is achieved by relative pivoting between the connector and the body, without interference with the ring. An actuating portion of a dose metering pump of the head is accessible on the top via a channel of the connector, while a tubular outer portion of the connector covers the area of attachment to the body, by axially extending an outer wall of the body.

17 Claims, 9 Drawing Sheets

(52) U.S. Cl.
CPC .. *B05B 11/00412* (2018.08); *B05B 11/00416* (2018.08); *B05B 11/3059* (2013.01); *B05B 11/0032* (2013.01)

(58) Field of Classification Search
USPC ..... 222/153.11
See application file for complete search history.

(56) References Cited

U.S. PATENT DOCUMENTS

| | | | | |
|---|---|---|---|---|
| 2013/0140332 | A1 | 6/2013 | Csaszar | |
| 2017/0000237 | A1 * | 1/2017 | Lefevre | A45D 34/02 |
| 2019/0060929 | A1 * | 2/2019 | Delmon | B05B 11/0038 |

FOREIGN PATENT DOCUMENTS

| | | | | |
|---|---|---|---|---|
| FR | 3 018 033 | | 9/2015 | |
| WO | WO-0192116 | A2 * | 12/2001 | B65D 45/322 |
| WO | 2015/128572 | | 9/2015 | |
| WO | 2017/060631 | | 4/2017 | |

OTHER PUBLICATIONS

Written Opinion of the ISA for PCT/FR2019/052805 dated May 25, 2020, 7 pages.

* cited by examiner

DEVICE FOR PACKAGING A FLUID PRODUCT AND DISPENSING THE PRODUCT IN DOSES, INCLUDING A REUSABLE BOTTLE

CROSS-REFERENCE TO RELATED APPLICATIONS

This application is the U.S. national phase of International Application No. PCT/FR2019/052805 filed Nov. 26, 2019 which designated the U.S. and claims priority to FR 18 72394 filed Dec. 5, 2018, the entire contents of each of which are hereby incorporated by reference.

TECHNICAL FIELD

The invention relates to the technical field of packaging, and more particularly to the packaging and dispensing of a liquid or viscous product intended to be stored in a fluidtight manner and to be dispensed in the form of unit doses by means of a dispensing assembly.

The object of the invention is more particularly a device for packaging and dispensing a fluid product, including a reusable protective assembly for covering an inner unit including a container intended to contain the product.

This device for packaging and dispensing a product, generally a fluid, typically comprises a dose metering assembly suitable for dispensing a dose of the product. To enable pharmaceutical applications or those related to cosmetics, the delivered dose must be constant and precise. In order to avoid pumping a volume different from the desired dose (cavitation for example), the metering assembly typically comprises a metering pump without air intake (conventionally designated by the expression "airless").

TECHNOLOGICAL BACKGROUND

There are known devices for packaging and dispensing a fluid product of the airless metering pump type, for example from patent EP 2 153 908. The inner portion is a reservoir portion which comprises the container, the associated piston, and a container connection interface for connecting the dispensing portion of the head to the reservoir of the lower inner portion (after filling), which requires sealing and maintaining the assembly via an upper external peripheral part belonging to the metering assembly. In a mounted state of the head forming the metering assembly, the inlet of the metering pump extends to a tubular end of the reservoir opposite to the bottom of the reservoir portion.

This type of connection interface makes it possible to prevent access to the container-head connection area, in order to prevent any entry of air. However, this type of limiting configuration prevents the reuse of certain parts of the device, particularly if one wishes to be able to change the reservoir portion (in which the contents have typically been used up) and to replace it with a new inner unit, filled with new content that can be dispensed in doses.

There is therefore a need to allow variations in the covering options allowed by the elements of the protective assembly, as well as to guarantee fluidtightness for a typically cylindrical container, and to allow changing an inner unit including the reservoir portion.

This turns out to be complex, because it is not sufficient to replace an outer bottle, for example of the type with a threaded neck (see for example the reservoir portion shown in FIGS. 6A and 6B of patent US 2013/0140332), nor to replace an internal reservoir as in the solution of patent DE 102008022595 or patent FR 3018033, to recreate a complete device providing new content. The context of using an airless metering pump does not allow this type of connection to be used, since no air can be allowed to enter.

In particular, the metering pump must not be separated from the container. In addition, the container filled with content must preferably be a right circular cylinder in order to guarantee a good seal in the contact between the piston and the inner face of the container (dynamic sealing, meaning without a gasket). This helps to avoid in particular:

- modifying the characteristics of the formula by selective evaporation of some of its compounds, from inside the pack to the outside,
- oxidation of certain components of the formula which would be sensitive to contact with oxygen that could enter from outside the pack to the inside.

In addition, the use of containers with necks proves to be unsuitable for mass production, particularly when the liquid product is viscous (the product being able for example to correspond to a wide range, from 1000 centipoise (cps) to 40,000 cps). Indeed, it has been observed that the narrowness of the opening due to the presence of a neck has the effect of slowing down the fill rate. In addition, with a necked container it is necessary to provide a format of the covering body which depends closely on the container used, in order to avoid wasting an enormous amount of internal space that serves no purpose.

OBJECTS OF THE INVENTION

It would therefore be of interest to better integrate an airless metering assembly which can satisfy numerous technical requirements desirable for such a system (static sealing, dynamic sealing, and protection of the product flow path, ability to dispense a wide range of viscosities) while also being able to integrate many types of coverings and to limit the disposable parts.

Obtaining such a system is highly complex because many parameters interact, often antagonistically.

The object of the invention is to remedy one or more disadvantages of devices of the prior art and to propose a device for packaging and dispensing which is quite suitable for the various requirements of the practice (in particular the requirement for fluidtightness) and is compatible with very different covering options while allowing disassembly that does not affect the integrity of the dispensing flow path.

To this end, according to the invention a device is proposed for packaging and dispensing a fluid product, comprising: a body which is hollow and provided with a bottom or a lower edge at a lower end of the body; a reservoir portion which comprises a container defining an internal volume of the reservoir and extending into an inside volume defined by the body, the container having a longitudinal axis and an opening (called the fill opening) at an axial upper end of tubular shape; a head which comprises a stopper member (closing off the opening) and a metering assembly of the airless type, the metering assembly comprising a metering pump and a movable actuating portion to enable dispensing the fluid product; and an upper connector onto which the body is fixed in a locked configuration of the upper connector, the upper connector having a radial portion which extends radially outward, around a channel for the passage of the metering pump, to a tubular outer portion including first attachment means;

wherein the device has an outer side wall extending around the longitudinal axis, from the lower end of the body to an annular upper edge of the tubular outer portion, with the distinctive characteristic that the device for packaging and dispensing comprises a retaining ring, preferably made as one piece, which is:

- in contact with the body and mounted to be axially movable relative to the body in the unlocked configuration of the upper connector;
- designed and arranged to lock axially together the reservoir portion and the head regardless of whether or not the upper connector is in the locked configuration; and
- engaged on engagement rims distributed over an outer face of the container and on the head, such that the head, the reservoir portion, and the ring constitute a preassembled inner unit of the device, the retaining ring being covered by the outer side wall in an assembled state of the device;

in the knowledge that the body, preferably made as one piece, comprises second attachment means which, in said assembled state and for the locking configuration, are axially engaged with the first attachment means, the first attachment means and the second attachment means forming a removable connection between the upper connector and the body, the upper connector being integrally secured to the second attachment means by a locking action which takes place by a pivoting, about the longitudinal axis, of one among the upper connector and the body relative to the other.

This type of device advantageously makes it possible to have a high-performance inner unit, which can be changed while reusing several protective portions formed by the outer body and the upper connector, as well as a cap, where appropriate, which can be mounted on the upper connector, for example above the outer side wall. It is thus possible to change the inner unit without necessarily discarding reusable protective elements, thanks to a configuration which preserves the integrity of the dispensing flow path (integrity of the "airless" system).

In the event of a replacement to substitute the inner unit, the operations are easy, requiring no tools and no disassembly action concerning/affecting seals of the inner unit. This ensures that the dispensing flow path is completely intact from one use to another, even in the event of a replacement. Indeed, the retaining ring prevents access to the container-head connection area, to prevent any entry of air.

The body protects the container, and the upper connector protects the ring maintaining the seal. In other words, a functional portion of the device is defined which is entirely internal (inner unit), formed by the head (of which the metering assembly is a part) and the reservoir portion. This functional portion, which satisfies the high sealing requirements, in particular in the cosmetic or pharmaceutical field before and even after the first use, can be designed separately. The functional portion can thus be produced in a very large number of units (several million for example), while being integrable into a device that is customized (in format and in the choice of material for the body) due to the adaptation of the upper connector and the body, and possibly by sizing; adapting the retaining ring.

The movable wall of the container is thus very well protected. It makes it possible to ensure a sealed separation and to maintain identical pressure between the fluid product contained in the reservoir and the air of the peripheral volume between the container and the body.

Also, with this arrangement, in the locking configuration it is possible to hold the inner unit in position simply by axial pressure against a lower inner face of said radial portion of the upper connector. The inner unit can be fully immobilized within an inner housing defined by the body and the upper connector, in particular be unable to move axially. Optionally, the sliding of the reservoir portion can be blocked in the usual manner by a retainer (contact of the reservoir portion against the bottom of the body or axial contact of the ring of the inner unit against the top of the container). A sandwiching effect may be preferred, for example between the wall/radial portion of the connector and the upper body.

In other words, as soon as the upper connector is unlocked (with or without removal of this upper connector), the user has the direct possibility of extracting the inner unit from the body since the latter can move freely upwards, without any retaining effect by the hollow body.

In a less preferred variant, the removal of the inner unit may also involve rotation, for example when an unscrewing motion is sufficient to extract the inner unit from the body. Also in this case, the inner unit is axially movable and is easily removed from the hollow body, without tools or any tricky unclipping operation. However, it takes longer to disengage the inner unit, so an unhindered insertion of the reservoir portion into the body is preferred.

The retaining ring may extend radially distanced from the outer side wall and/or is able to slide along this outer side wall by having an outer side face devoid of any protruding reliefs that would come into contact with the outer side wall.

According to a first option, the ring is free to rotate about the longitudinal axis of the container, such that during insertion of the reservoir portion into the body and in a fully inserted state of the reservoir portion (in which the ring bears axially against a stop surface of the body perpendicular to the longitudinal axis), the inner unit is free to rotate. This type of arrangement allows easy assembly, with no need to verify accuracy in the angular positioning of the inner unit.

According to a second option, the ring has a means of rotational indexing relative to the body, such that the inner unit is rotationally locked when the reservoir portion is in a fully inserted state (state in which the ring bears axially against a stop surface of the body which is perpendicular to the longitudinal axis).

In this second option, it is understood that the ring preferably can slide freely when the inner unit is in the fully inserted state.

The means of rotational indexing may engage with a guide relief provided on the body, so as to form a foolproofing means (possibly with position indicators visible at the time of assembly between the inner unit and the bottle forming the body). This can prevent losing the correlation between the outer body and/or the connector, and the content or type of inner unit to use. It can also facilitate detection of a counterfeit, where applicable.

In this case, the container is preferably not narrowed at its upper end and the opening may typically define a diameter of at least 15 or 16 mm, preferably greater than 20 mm. Such a diameter of the fill opening may correspond to at least 75 or 80% of the container diameter defined around a piston at the lower end of the container. The dimension of the opening diameter may be larger, up to the diameter of the container (therefore, where appropriate, corresponding to 100% of the cross-section of the container).

According to one particular feature, the first attachment means and the second attachment means form a bayonet-type connection system. This arrangement makes the attachment both robust and easy to unlock.

Typically, the second attachment means are formed on an inner face of the upper connector, preferably on the inner face of the tubular outer portion, within an annular area which is located lower than (entirely below) the retaining ring in the locked configuration of the connector.

Optionally, the upper connector has at least two internal lugs, acting to establish the bayonet-type connection.

The upper connector may also have axial slots within a same generally tubular outer skirt that is part of said upper connector. The axial slots make it possible to obtain axial travel within the skirt, which facilitates the assembly and disassembly operations.

Such slots may advantageously be hidden by an annular part, for example a part forming a ferrule, which surrounds the outer skirt. More generally, the connector can have a main part forming the outer skirt and the radial portion supporting/retaining the inner unit from above, and an auxiliary part without contact with the inner unit and constituting the upper portion of the outer side wall of the device. The part forming a ferrule typically constitutes such an auxiliary part of the upper connector.

More generally, the upper connector may have, in the outer skirt:

at least one flexible portion, preferably in the form of a portion with radially outward travel, which is preferably thinned in comparison to the rest of the upper connector, in the knowledge that all or part of the first attachment means are located in the at least one flexible portion.

When the upper connector has axial slots, in the same outer skirt of generally tubular shape (skirt that is part of the connector), each of the slots is preferably designed to separate a flexible portion of the skirt from an adjacent portion of the skirt which is more rigid than said flexible portion.

The part forming a ferrule is part of the connector and may, when the flexible portions are in a state at rest, extend radially outward at a distance with respect to each of the flexible portions, the part forming a ferrule having an inner collar or similar section reducing the upper opening of the part, suitable for engaging with at least one relief comprised in the main part of the upper connector to form a means for blocking relative rotation between the main part and the auxiliary part of the connector.

When the upper connector has a part forming a ferrule, the latter laterally surrounds the outer skirt of the upper connector, forming a continuous perimeter constituting a portion of the side wall of the device.

For example, the part forming a ferrule may be made of metal, provided with an external metallic coating, or may made be of glass.

The radial portion of the upper connector may be a transition portion between:

an upper sleeve radially proximal to the metering pump;

and the tubular outer portion radially distal to the metering pump, the upper sleeve and the tubular outer portion extending away from the radial portion in respective opposite axial directions, parallel to the longitudinal axis.

According to one option, at least one rotation-preventing relief is provided externally on the upper connector, preferably on the radial portion thereof, in order to prevent relative rotation between the part forming a ferrule and the upper connector, about the longitudinal axis.

According to one feature, the upper connector comprises a part forming a ferrule which may have a circular opening of a diameter equal to the outside diameter of an upper sleeve or between the outside diameter of an upper sleeve of the upper connector and the diameter of the tubular outer portion. For example, the part forming a ferrule covers at least 90% of the radial portion (this percentage corresponding to a surface area ratio between the upper surface area of the radial portion and the upper surface area of the part forming a ferrule).

Optionally, the upper connector has an outer skirt comprising at least one portion with radially outward travel, which is preferably thinned in comparison to the rest of the upper connector, all or part of the first attachment means being located in the at least one portion with radially outward travel.

Optionally:

the retaining ring is made as one piece and is in only axial contact with the body, from above; and/or the retaining ring bears axially against an upper annular edge of the body, where an upper opening of the body is defined, preferably of generally circular cross-section.

Preferably, the upper opening of the body has a diameter which is substantially equal to an outside diameter of the container. Thus the volume/the capacity of the device is optimized, while minimizing the dead volumes, it being possible to reduce the peripheral volume to a minimum.

As an example, the difference between the maximum inside diameter of the hollow body and the outside diameter (substantially constant) of the container may be less than 20 mm, preferably less than or equal to 15 mm, for a container having an inside diameter typically greater than or equal to 25 mm. More generally, the ratio of inside diameters can easily exceed 0.6:1, between the inside diameter of the container and the inside diameter of the hollow body.

According to one particular feature, the retaining ring has a cylindrical outer face, of which the outer surface is preferably smooth.

Optionally, the engagement edges/rims distributed over the outer face of the container and on the head engage in a housing of the retaining ring, formed by an internal recess or between two reliefs of the retaining ring that are spaced axially apart from each other, the housing being located in an intermediate axial position, and at a distance respectively between a lower edge of the cylindrical outer face and at least one upper edge of the cylindrical outer face.

In various embodiments of the device according to the invention, recourse may optionally be made to one or more of the following arrangements:

the body is made as one piece;

the body has an upper opening, the ring playing no role in closing off the upper opening and not interfering with the fill opening of the container;

the container is of the type with no neck;

the stopper member forms a support for the metering assembly;

the container has a circular cross-section, at least at the upper end, the ring defining a circular opening for insertion of the container into the inside volume of the body;

the body defines a first covering periphery, the head removably supporting, preferably without any attachment, the upper connector which is made integral with the body in the locked configuration and which surrounds the metering assembly to define a second covering periphery;

the assembly formed by the head and the upper connector further comprises a removable cap, preferably attaching to the upper connector in a storage configuration, the body, the upper connector, and optionally the cap giving the device its external shape in the storage configuration;

the body has a flat upper face, with no reliefs or annular projections on this upper face;

the body is of the type with a lip and has one or two notches separating the lip into discontinuous lip portions;

when the body has a bottom, at least one lower bearing surface which has a pressure balancing orifice may be provided to define a base plane of the body; this orifice may be offset from the lower bearing surface that it extends recessed from the base plane;

the container is substantially cylindrical and extends around a longitudinal axis, the fluidtight and movable wall being defined by a piston movable in translation along the longitudinal axis;

the container has a side wall adapted to guide a piston, the side wall having a circular cross-section widening towards the lower end of the container and extending to an opening for mounting the piston in the container;

the fluidtight and movable wall is defined by a flexible retractable portion, the upper end of the container forming a rigid connection;

the body is a bottle of the type with a lip, made as one piece and preferably of glass;

the one-piece body comprises the first attachment means for attachment on a side surface portion of a neck, adjacent to a shoulder of the bottle;

the bottle, preferably made of glass, has at least one lateral cavity for receiving an internal lug comprised in the second attachment means (on an inner face of the upper connector), the lateral cavity being an external cavity (opening radially outward) defined axially between a portion of the lip and the shoulder, and extending circumferentially between a termination zone where a stop surface is formed having a radially outer edge, and an access channel of narrowing cross-section; the access channel provides an entrance for a lug moved tangentially around/along the annular groove located between the lip and the shoulder;

in the lateral cavity there exists at least one relief protruding relative to a bottom surface of the lateral cavity, in the knowledge that a relief constitutes a catch whose height (measured from the bottom surface) is less than the depth of the cavity measured from the radially outer edge of the stop surface defining said cavity (between this edge and the bottom surface);

each of the reliefs may be designed and arranged to oppose the unlocking of the removable attachment between the upper connector and the body;

the locked configuration is obtained when each internal lug is placed in a corresponding lateral cavity, extending on either side of the stop surface of the cavity, beyond the catch of the cavity; this arrangement with a groove of discontinuous depth, and relatively elongated lugs, using at least two lateral cavities, secures the attachment and prevents accidental disconnection.

According to one particular feature, the upper connector has internal lugs which are each of elongated shape along a circumferential direction between a front end, preferably tapered, and a rear end, and each have an intermediate recess between the front end and the rear end, in order to receive, in the locked configuration, a projection formed integrally with the bottle, which is located in the lateral cavity and which allows constituting the stop surface.

Optionally, the side wall has a cross-section for which the profile is substantially constant from the lower end to the annular upper edge.

According to another option, the side wall has a cross-section for which the profile grows progressively larger in cross-section towards the bottom of the tubular outer portion.

In the case of a covering that is in at least two superimposed parts, the container is typically inserted into the body from above, through the opening of the ring, which can make it possible to avoid an additional operation of closing the bottom by a cover after the container is in place.

In some embodiment options, it is possible to form a container and ring assembly and to insert the container into the body, before mounting the head to close off the lower portion with reservoir, without deformation of the wall. In this case, the upper portion of the container forms a seat for the stopper member (in particular an insertion portion of this member), while the ring rests on the top of the body to define a snap-in area, facing the outer perimeter of the upper portion of the container. A peripheral portion of the head can then be inserted into this snap-in area, so that by fixing the head on the lower portion with reservoir, both the sealing against the container and the relative retention of the component parts of the inner unit are achieved.

Of course, this type of assembly order is only applicable for mounting an original inner unit, under production conditions without contamination, not for integrating a replacement inner unit.

In all cases, the seal is excellent and thus guarantees satisfactory subsequent operation of the device for dispensing.

According to the invention, also proposed is a kit for packaging and dispensing at least one fluid product, comprising:

said device for packaging and dispensing according to the invention (with a body, an inner unit, and an upper connector optionally topped by a cap), the inner unit of this device constituting a first cartridge filled with a first product; and a second cartridge filled with a second product, the second cartridge being composed of another inner unit identical to the inner unit of the first cartridge, wherein the retaining ring of each of the inner units forms an external collar or bulge arranged to extend outwardly relative to the container;

and wherein the body and the upper connector (which can be separated by a movement in opposite directions for an unlocked configuration of the upper connector) make it possible to protect a given cartridge chosen indiscriminately among the first cartridge and the second cartridge, after insertion of the container of the given cartridge into the body and peripherally surrounding the metering portion of the given cartridge by the upper connector, and for a locked attachment configuration between the upper connector and the body, by using removable attachment means composed of the first attachment means and the second attachment means (reusable and reused attachment means).

BRIEF DESCRIPTION OF THE DRAWINGS

Other features and advantages of the invention are apparent from the description given below, with reference to the appended drawings, which represent non-limiting examples of some embodiments and of implementations of the object of the invention. In these drawings.

DESCRIPTION OF PREFERRED EMBODIMENTS OF THE INVENTION

Figure 1:
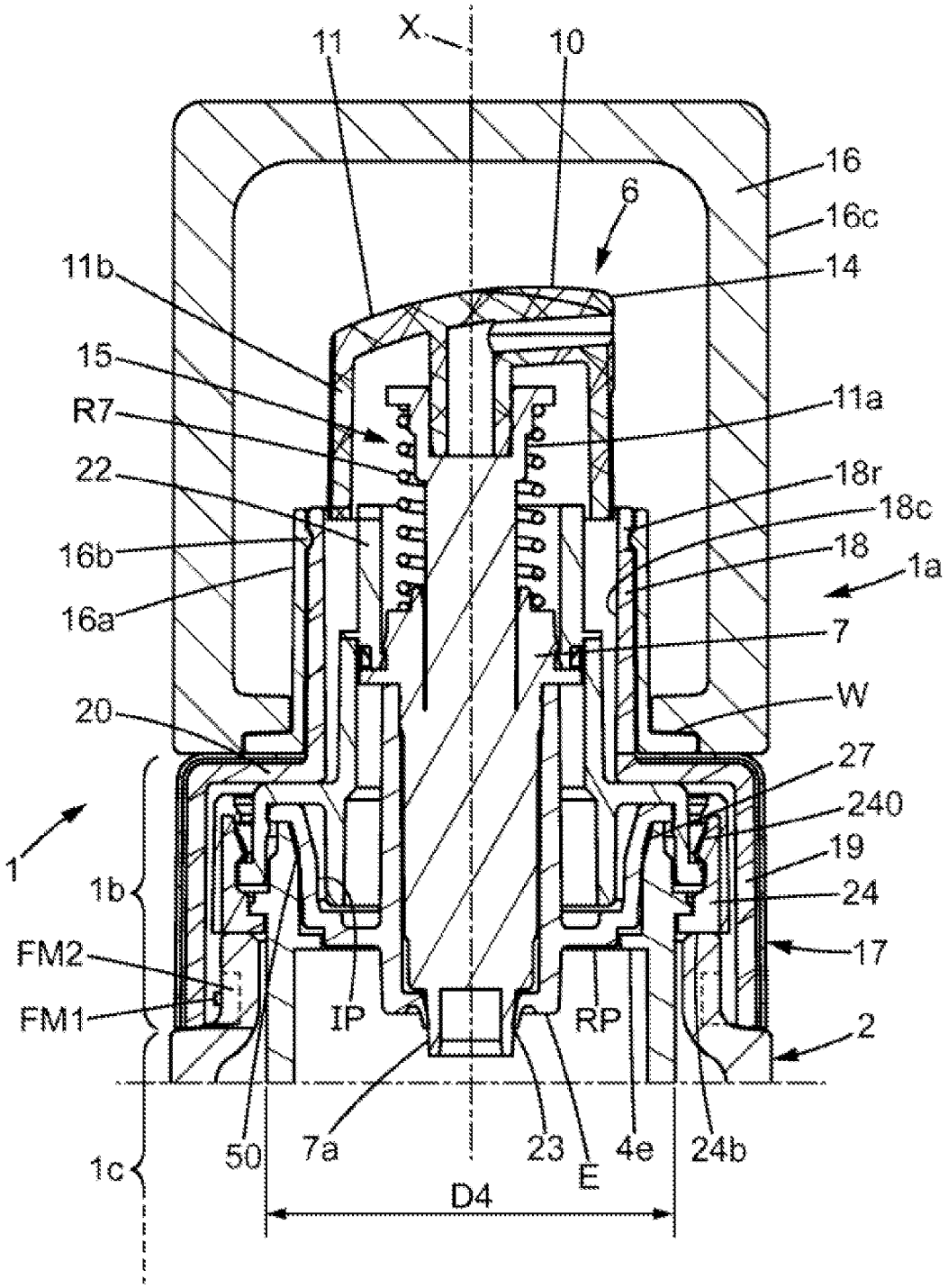
FIG. 1 is an axial section view of a device according to the invention, which in particular shows an inner portion, including the reservoir and a metering assembly, assembled by means of a peripheral ring and a protective outer portion making it possible to detach the reservoir by a simple rotational movement about a longitudinal axis of the device.

In the various figures, the same numerical references designate similar elements in the various exemplary embodiments shown and described.

As shown in FIGS. 1, 10 and 11A-11B and 12, the device 1 for packaging and dispensing comprises a body 2, typically a bottle body, with a bottom 2*a* which defines a support base B, a container 4 which extends (entirely, essentially, or partly) inside the body 2 and makes it possible to store the liquid or viscous product 5 to be dispensed, a stopper member S, preferably of thermoplastic material, assembled to the container 4 in a fluidtight manner and which forms part of a dispensing head 6 or tip. In a non-limiting manner, the body 2 may be defined by a single part of preferably rigid material, for example glass or plastic, opaque, translucent, or transparent. Alternatively, all or part of the body 2 may be made with metal, A coating may be provided to cover all or part of the outer face f2 of the side wall 2*b* of the body 2. The decorative coating may comprise any surface treatment compatible with the material of the body 2, for example lacquering on glass, metallization on plastic, anodization on aluminum, etc., and/or any decoration by processes such as hot foil stamping, screen printing, pad printing, label application, laser engraving, etc.

Figure 2:
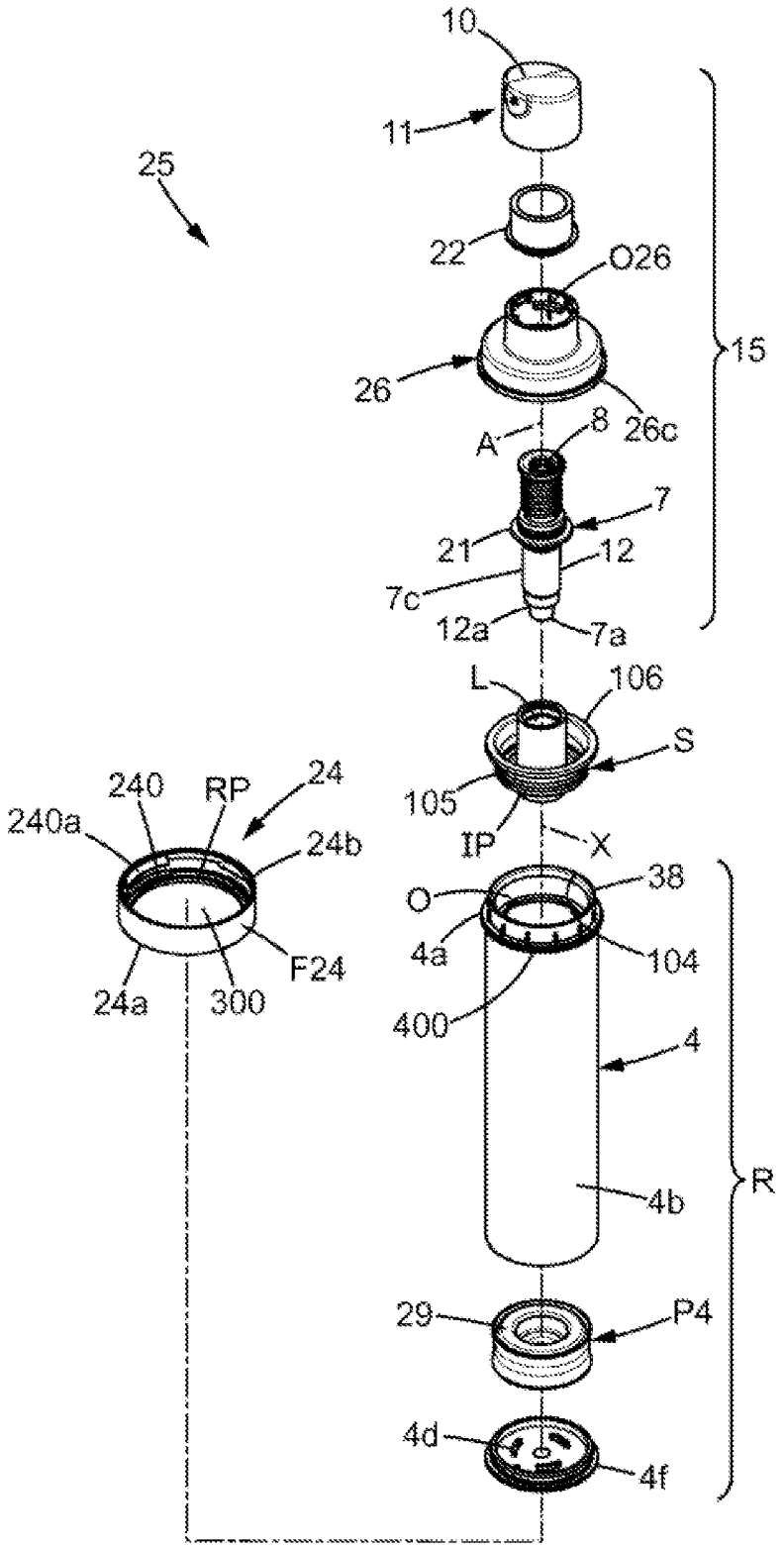
FIG. 2 represents, separately and in perspective, components of the inner portion of a device such as that of FIG. 1, showing the constituent parts of the reservoir and the constituent parts of a metering assembly, as well as the peripheral ring, and with an insertable part for closing the reservoir by engaging against a sealing surface defined by the upper end of the container forming the reservoir.
Figure 3:
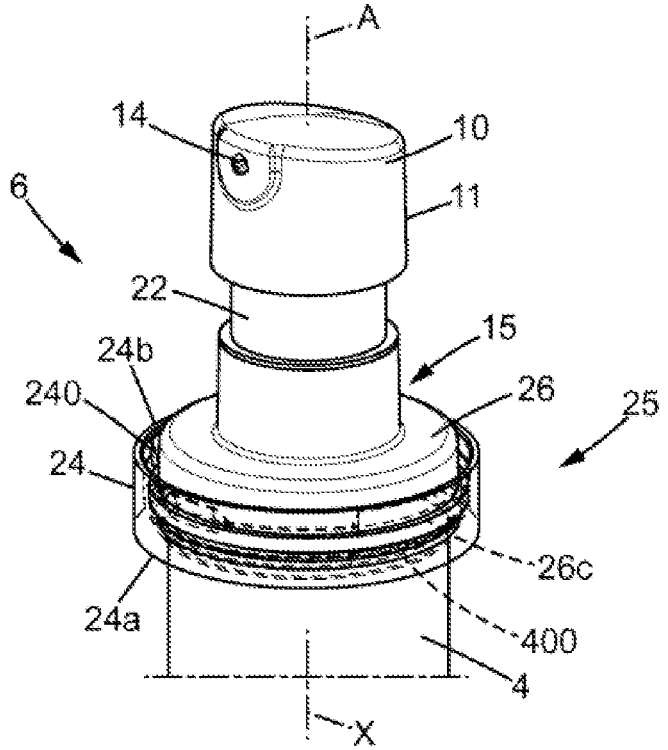
FIG. 3 illustrates an inner unit of the type able to slide partly into the outer body, and of which the peripheral ring maintains the attachment and sealing of the inner unit.

In the embodiment of FIGS. 1, 2, and 3, the body 2 is mounted after having completely assembled an inner unit 25 which combines a reservoir portion R and a dispensing head 6 including a metering assembly 15, The container 4 defines the reservoir of the reservoir portion R. The portion complementary to the reservoir portion R is the dispensing head 6 which includes the dispensing functions (with the metering assembly 15) and the function of closing the fill opening O of the container 4 (with a part forming a stopper member S).

A contact obtained during assembly (after filling) between the stopper member S and the container 4 of the reservoir portion R makes it possible to create the seal between an upper end 4*a* of the container 4, which is tubular and in practice is circular in cross-section (without this being limiting), and the metering assembly 15. The fill opening O is thus sealed closed at the upper end 4*a* which is typically circular, as is clearly visible in FIG. 2. As the upper end 4*a* is circular, it is possible to obtain a perfect static seal without resorting to an additional gasket. The stopper member S, here formed as one piece, is in continuous contact with the container 4 in an annular connection area. With reference to FIG. 2, the stopper member S is preferably designed as a part which comprises a flange 106 bearing on the top of the container 4 and/or a radial face provided to bear axially against an inner rim 4*e* provided on an inner face of the wall 4*b* of the container 4, Such a part is designed separately from the body 7*c* of the pump 7.

Preferably it is arranged to fill the container 4 before constructing/assembling the inner unit 25, and before sliding the container 4 into the body 2, It is understood that after filling, the head 6 can be mounted in a preassembled state, with the stopper member S which defines the bottom of this head 6, opposite to an actuating portion 10 of the metering assembly 15. As is clearly visible in FIGS. 1 and 2 and 10, the stopper member S is only partially inserted into the internal volume V of the container 4.

Referring to FIGS. 1 to 3, the circular shape is also particularly well-suited for allowing the container 4 to be extended axially by a head whose metering assembly 15 comprises a metering pump 7, The central axis X, around which the container 4 extends longitudinally, can be coincident with an axis A of the metering pump 7, in particular when the latter comprises an axially movable element such as a piston.

We will now describe more particularly an embodiment of a dispensing head 6 including the metering assembly 15, with reference to FIGS. 1, 2 and 3 and 10.

The head 6 is broken down here into a metering assembly 15 (in particular including the metering pump 7 and the actuating portion 10) arranged in the extension of the container 2, and a separate stopper member S which typically is partially inserted into the container 4. As is clearly visible in FIG. 1, the tip or head 6 may be partially or totally covered by a cap 16, A narrower female portion 16*a*, here cylindrical, may equip the cap 16 internally, to allow the cap 16 to be attached to the head 6 by a plastic-plastic radial contact between an inner face of the female portion 16*a* (here provided with lugs or a bead 16*b*) and an upper connector 17 covering the top of the inner unit 25. An upper sleeve 18 of the upper connector 17 has for example an annular groove 18*r* with which the corresponding protruding relief of the cap 16 engages. The female portion 16*a* may be more flexible or more elastically deformable than the rest of the cap, this female portion 16 being connected for example by welding W to the wall 16*c* of the outer body of the cap.

Referring to FIG. 2, a metering pump 7 which has an inlet 7*a* is mounted in the head 6 forming the metering tip. The stopper member S forms a part to support the metering pump 7, here from below. This stopper member S thus supports the metering pump 7 (and not the reverse), for example by keeping it at a given level at the upper end 4*a* of the container 4. As is clearly visible in FIG. 1, the inlet 7*a* of the pump 7 is defined at a first end of a dispensing channel (not shown). The pump 7 is of the "airless" type, meaning with no air intake, with a rod 11*a* or equivalent movable portion actuated during depression of an actuator, generally arranged in the upper portion of the device 1, thus allowing the fluid forming the product 5 to exit via a nozzle or similar distribution member 14, or to exit via an applicator (case of an applicator tip).

As shown in FIG. 2, the metering pump 7 comprises a pump body 7*c*, here cylindrical and provided with an external collar 21, The insertion portion 12 (which forms part of the body 7*c*) extends under the collar 21 to be housed in a channel L (also cylindrical) of the stopper member S.

Referring to FIGS. 1 to 3 and 7, a retaining part 26 is provided to extend annularly around the pump body 7*c* and to form an outer side face of the stationary portion of the metering assembly 15. The retaining part 26 extends longitudinally around the channel L, from a lower portion 26*b* provided with a skirt J to an upper end portion 26*d*. The upper end portion 26*d*, tubular, can be engaged with the external collar 21 formed on the metering pump 7, in the assembled state of the metering assembly 15. The external collar 21 can rest on the upper face of the retaining relief(s) 261 (FIG. 7) which make it possible to retain the pump 7. An optional annular part 22 may also be mounted on top of the collar 21, to close the upper opening O26 of the retaining part 26, while also engaging with a rim or external reliefs of the pump body 7*c*, just above the external collar 21. The annular part 22 typically further prevents access to a spring of the pump 7, by laterally covering this spring R7 under the actuation portion 10.

Figure 7:
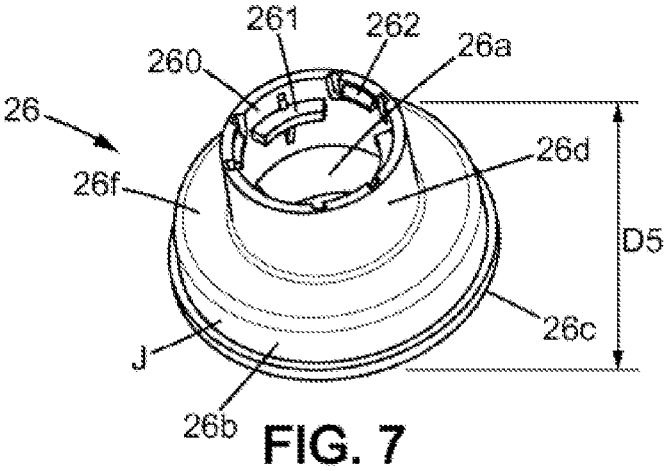
FIG. 7 shows a perspective view of an example retaining part usable in a stationary portion of the metering assembly and contributing, on the one hand, to an axial retention of the metering pump in a housing defined by the stopper member, and on the other hand to the bonding effect of the head against the reservoir portion, due to an external engagement rim engaged against the inside of the peripheral retaining ring.

As is clearly visible in FIGS. 2 and 7, the retaining part 26 may be defined by a cross-section transition piece between the lower part 26*b*, wider than the upper end 4*a* of the container 4, and the upper end part 26*d*, narrower than the upper end 4*a* and provided with an inner face 260 from which retaining reliefs 261, 262 project radially inwards to engage axially on either side of the collar 21.

FIG. 2 shows the group, here formed of two assembly parts 11 and 26 (here without the optional cap 16 shown in FIG. 1), which allows enveloping the metering pump 7. The push member 11 is formed of a rigid part and slides while being guided within the pump body 7*c*. The tubular wall 11*b* of the push member 11 may also optionally be guided angularly by an internal guide surface 18*c* (FIG. 1), here cylindrical, defined by the upper connector 17 which is mounted on the metering assembly 15. The upper connector 17, formed as one piece or as two pieces with a peripheral reinforcing part, typically in the form of a ferrule, has a central opening 18*a* for the passage of the actuating portion 10. This upper connector 17 will be described in more detail below.

A constriction E which defines an outlet of the channel L of the closure part S (at the volume V side) can form an annular bearing surface for a shoulder 12*a* of the insertion portion 12 which is formed near the inlet 7*a*. An annular lip, typically conical, supplements this constriction E to establish the seal with the bottom of the pump 7.

The operation of the metering pump 7 is of a type known per se, for example with a piston integral with the rod 11*a* (configured to increase the pressure in a metering chamber), slidably mounted in a longitudinal dispensing channel, A check valve provided at the inlet 7*a* defines a hermetic separation between the internal volume V of the reservoir and the dispensing channel of the pump 7.

When the push member 11 is depressed, here in response to vertical manual pressure exerted on the actuating portion 10, the rod 11*a* is lowered at the same time as an internal actuating element (for example a piston) which actuates the dispensing. During actual use, a cap 16 of the type shown in FIG. 1 is obviously removed so that the upper surface of the actuating portion 10 (here formed by a push member 11 having a tubular wall 11*b* which surrounds the spring R7) is exposed for actuation.

More generally, it is understood that the metering assembly 15 makes it possible to deliver a specific dose of product 5, this dose being ejected by creating a vacuum inside the container 4. As the pump 7 discharges the product 5 by creating a vacuum (negative pressure), a fluidtight and movable wall P4 is provided here, typically provided at the bottom of the container 4, which moves upward to compensate for the negative pressure in order to return the device to ambient atmospheric pressure before the next activation. The cross-section of this wall P4 is complementary to the tube defined by the container 4, and in particular is circular in the example shown.

An actuating portion 10, for example located in the tip 6 opposite the inlet 7*a* of the metering pump 7, is provided to allow the product 5 to exit from the tip or head 6 at an outlet of the metering pump 7, The actuating portion 10 is typically in the form of a push member 11, movable along a longitudinal axis which may be parallel to longitudinal axis X (here a central axis) of the container 4. The push member 11 has a substantially tubular wall 11*b* and is connected at the top to the upper end of the rod 11*a*, The stopper member S is integral with an insertion portion 12 which belongs to the metering pump 7, It is understood that end 7*a* is part of the insertion portion 12 and may, according to one option, project relative to the stopper member S in a direction opposite to the actuating portion 10 (in practice: project downward when the device 1 for packaging and dispensing is in a vertical position with the bottom 2*a* defining a support base B).

The distribution member 14, for example in the form of a nozzle, is in fluid communication with the outlet in order to deliver and direct a dose of product. Although the examples illustrated show a dose delivered in a radially outward direction, other configurations are possible: for example, with a product outlet oriented substantially axially or in a direction (typically not vertical) forming any angle with the lengthwise direction of the device 1. This distribution member 14 extends transversely in a position adjacent to the actuating portion 10 and follows the movement of the push member 11, Locking the push member 11 in a raised position may optionally be provided, for example by abutment contact when this push member 11 is rotated away from a predefined orientation of the distribution member 14, A slot separating two stop areas can thus allow moving the push member 11 to the predefined orientation.

The reservoir portion R will now be detailed with reference to FIGS. 2, 3, 10 and 12.

The container 4 comprises at least one fluidtight and movable wall P4, which allows the volume V of the reservoir defined by the container 4 to decrease as the product 5 is consumed. The container 4 may have a stationary tubular wall 4*b*, preferably rigid, against which the fluidtight and movable wall P4 is mounted. The container 4 forms the lower portion of the inner unit 25, covered and protected by the body 2 which forms an external visible portion in the device 1 for packaging and dispensing.

When the body 2 is transparent, the container 4 can be seen. In this case, the container 4 may typically have a shape that is cylindrical or slightly tapered towards the opening 13 of the body, and a piston 29 defines the fluidtight and movable wall P4, This is considered more aesthetic than a flexible pouch or similar container 4 having a fluidtight and movable wall P4 which retracts due to the flexibility of the material used, Of course, the option with a piston 29 can be used with any category of covering/protection, provided that the body 2 does not have any constriction or narrowing of its cross-section limiting the cross-sectional area to dimensions smaller than that of the wall 4*b*.

Figure 10:
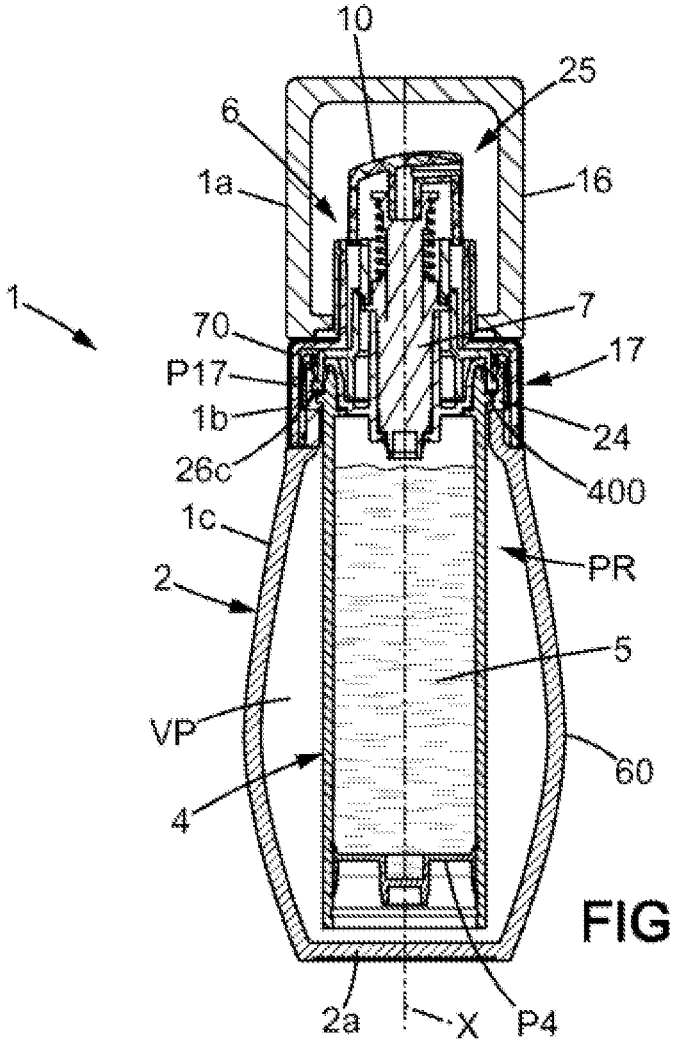
FIG. 10 is an axial section view of a device according to the invention, in a variant with a body, typically made of glass, in which the cross-section varies, and with an upper connector whose cylindrical outer face substantially aligns with the respective neighboring cross-sections of a cap and of the body.
Figure 12:
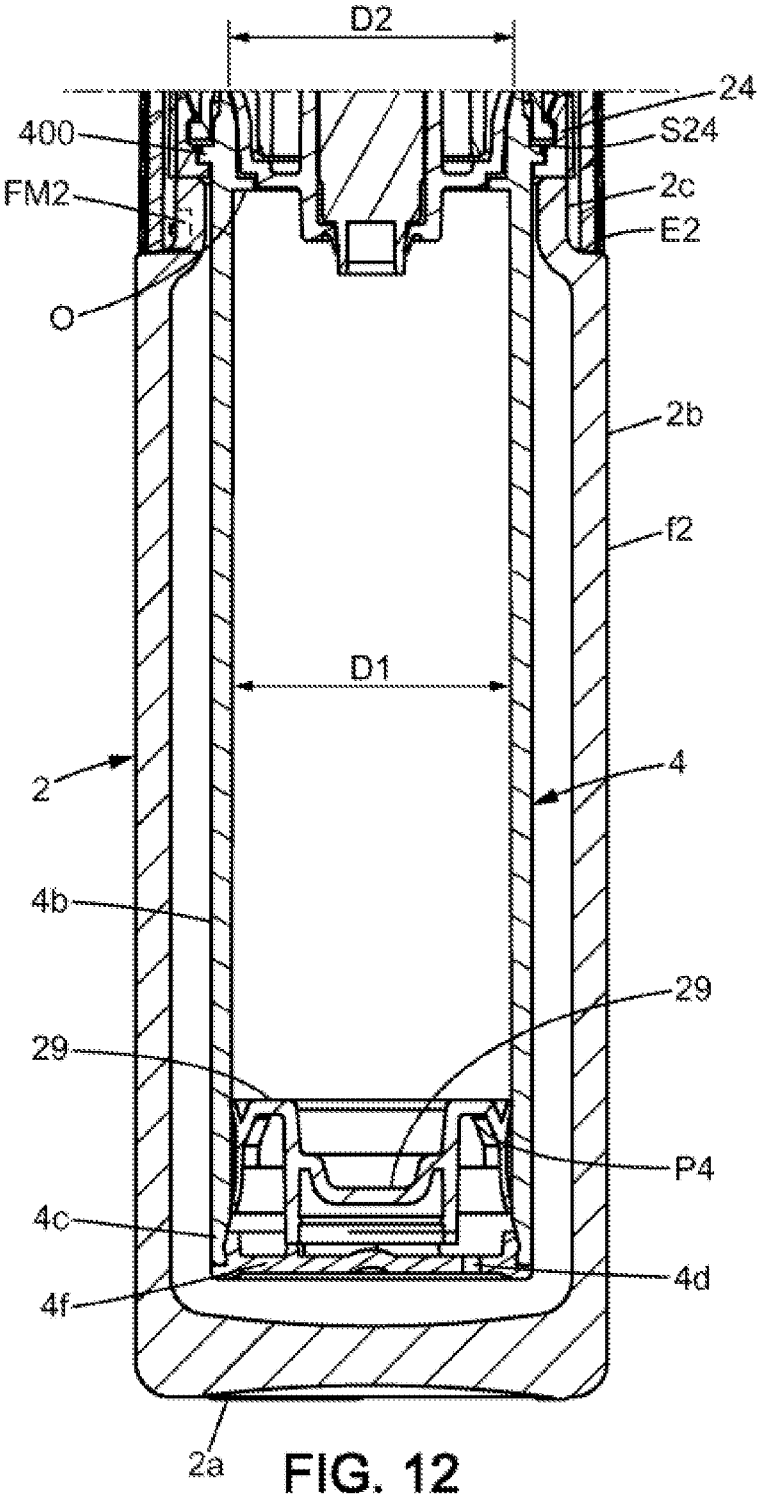
FIG. 12 is a section view of an exemplary relative arrangement between the container and the outer body, here in the case of a reservoir portion which uses a piston.

As illustrated in FIGS. 2, 10 and 12, the piston 29 has for example a circular cross-section which allows ensuring a good seal. It is then understood that the cross-section of the guiding rigid wall 4*b* is circular. Under the piston 29, an attached bottom part 4*f* may optionally be provided (integral with the side wall 4*b*) and at least one orifice 4*d* may be used to maintain at a sufficient level the pressure exerted against a lower face 29*a* of the piston 29 opposite to the opening O for filling with product 5.

As illustrated in FIG. 12, the piston 29 ensures a sealed separation on the one hand, and on the other hand maintains an identical pressure between the fluid product 5 contained in the reservoir and the air of the peripheral volume VP. In addition, the piston 29 may have a profile that matches the lower surface 6*a* of the head 6 extending inside the container 4, as is clearly visible in FIG. 1. In this non-limiting example, the piston 29 defines an internal cavity, positioned centrally, for receiving a projecting end of the channel forming the inlet 7*a* when the piston 29 is raised due to consumption of the product 5. This makes it possible to approach complete delivery of the product 5 (for example about 95% or more of product delivered, by mass), typically with the dead volume eliminated or greatly reduced.

The dynamic sealing produced between the piston 29 and the side wall 4*b* can be achieved with low frictional force of the piston 29, in particular when the product 5 has a high viscosity. Indeed, the force of the user pressing the push member 11 must overcome the return spring R7, the viscosity of the cosmetic product, and the friction of the piston 29. In order to reduce the friction of the piston 29 and minimize the force the user must provide, a very high geometric precision of the side wall 4*b* of the container 4 (and of the piston 29) is required if one wants to guarantee a given level of frictional force of the piston while obtaining the seal, which prohibits giving any decorative function to the container 4 (because the decorative functions typically involve heating or mechanical deformations which alter the integrity of the wall 4*b*). A slightly conical geometry of the wall 4*b*, with an enlargement towards the lower end 4*c*, can contribute to facilitating insertion of the piston 29 without damage and to obtaining a satisfactory seal.

The insertion of the piston 29 during assembly can be done advantageously from the bottom, at the lower end 4*c*, which avoids having the piston 29 travel the entire height of the container 4 to reach its filling position, clearly visible in FIG. 1. With bottom mounting, the piston slides for a short distance into the container 4 and is not damaged by friction for almost the entire length of the container 4. The risk of damage to the piston 29 is thus reduced (good dynamic sealing during uses of the device 1).

In an alternative embodiment (not shown), the fluidtight and movable wall P4 is defined by a flexible wall or flexible pouch which can retract and/or deform to reduce the internal volume of the container 4. The wall P4 extends preferably opposite to end 4*a*, which is rigid and which may be identical to what is shown in FIG. 3. With this type of container 4, a pressure-balancing orifice 2*d* may be provided when the body 2 has a bottom 2*a*. The body 2 may be made of an opaque material to hide the folded and/or contracted state of the pouch or flexible portion of the receptacle 4 as the product 5 is consumed.

According to one option, at least the portion of the container 4 which forms the pouch is made of a flexible and fluidtight material (and offering a good level of neutrality to cosmetic or pharmaceutical formulations), for example polyethylene.

The fluidtight and movable wall P4, in the form of a pouch which moves by contraction, can be advantageous in particular in the following two cases:

- to offer a very high level of protection to the product contained in the container 4, in particular if the product is sensitive to oxidation; in this case the pouch is defined by a laminate comprising an oxygen-barrier material such as a layer of aluminum or EVOH, in order to offer better protection than a container 4 with a piston (high protection due to the fact that this thus eliminates the natural permeability of polyolefins used in thicknesses of a millimeter or so and the fact that the risk of infiltration between the piston 29 and the fixed wall is eliminated).
- when the outer body 2 is of a shape very far from a cylinder (at least for its lower portion), because the pouch makes it possible to match the interior shape of this body 2 and thus to minimize the wasted space; the ratio between the contained volume and the general size of the device 1 is thus optimized.

An assembly of the inner unit 25 will now be described, without limitation, with reference to FIGS. 1, 2, 3, 7 and 10.

In the mounted state of the inner unit 25, as shown in particular in FIGS. 1 and 10, the upper end 4*a*—typically rigid—of the container 4 may define:

- a first fluidtight annular contact area 27 with the stopper member S, so that the product 5 can only exit the container 4 through the inlet 7*a* of the metering pump 7; and
- a second annular contact area 28 bearing axially on a base portion forming an inner rim RB of the ring 24, which makes the container 4 integral with the metering assembly 15.

The first contact area 27 is, in this non-limiting example, obtained at an inner annular portion of the upper end 4*a* of the container 4, while the second contact area 28 is defined at an outer annular portion of the upper end 4*a*.

The ring 24 is a retaining ring, forming an external peripheral portion of the inner unit 25, and which can be associated with the stopper member S to enable locking the assembly between the two sub-assemblies 15 and R shown in FIG. 2, namely the metering assembly 15 and the reservoir portion R. The stopper member S can be associated with one or the other of these two sub-assemblies. In one embodiment, the container 4 is first filled and closed off, by attaching the stopper member S with a step of inserting an insertion portion IP of the member S into the cylindrical upper end 4*a*. The metering assembly 15 can then be put on or fitted into the channel L, so as to simultaneously:

- be inserted into the channel L, by the insertion portion 12 of the pump 7, and
- cover (preferably circumferentially, with continuous covering) the outside of the upper end 4*a*, by means of the outer skirt J of the metering assembly 15.

Alternatively, the stopper member S is already covered by the outer skirt J of the metering assembly 15 before the opening O is sealed closed.

To maintain an impact-resistant interconnection, it is preferable that the container 4, of which the wall P4 is movable or flexible and retractable, be inserted through the opening 300 of the ring 24 from above, to rest axially on the inner rim RB. Alternatively, however, the container 4 is mounted with insertion of the rigid upper end 4*a*, from below the ring 24, for example using a bayonet-type connection in the inner surface S24 of the ring 24, which prevents the container 4 from sinking further during assembly of the dispensing head 6 on the reservoir part R.

The closure of the fill opening O is made possible by a mode of sealed attachment compatible with the rigidity of the container 4. The mode of sealed attachment between the container 4 and the stopper member S can be made robust;

- by using a conical surface in the upper end 4*a*, which makes it possible to define the first annular contact area 27, and
- by covering the stopper member S by the retaining part or member 26 (here formed of an additional part) retained axially towards the bottom 2*a* by the ring 24, in particular by the internal reliefs 240 in the non-limiting example of FIGS. 1 and 10.

Of course, in alternatives the first contact area 27 can be defined otherwise, for example by an annular contact located on the outer side of the upper end 4*a*, closer to opening 13 than the second contact area 28. More generally, the first contact area 27 can be chosen among the inside surface, the outside surface, the upper surface, one of the two angles, or a combination of these surfaces of the upper end 4*a*.

As is clearly visible in FIGS. 1 and 2, the annular surface forming the sealing area may advantageously be formed on a flared inner face 104 of the upper end 4*a* and may have a sloping portion which extends radially inward and in the direction of the bottom 2*a*, from an upper radial portion.

The insertable closure portion 105 that is part of the stopper member S is in radial annular sealing contact with the inner face 104 of the upper end 4*a*, such that the upper end 4*a* and the stopper member S are connected by fitting together in a sealed manner. The first annular contact area 27 is here defined at a flange 106 of the stopper member S which is axially distal from the bottom 2*a*, In the example of FIG. 1, it can be seen that the flange 106 covers the inner face 104.

The manner of interlocking between the tip 6 and the upper end 4*a* may be as follows:

- the male conical bearing surface of the stopper member S is of a slightly larger diameter than that of the female bearing surface defined by the inner face 104;
- during final assembly, the outer flange 26*c* of the retaining part 26 snaps into the internal reliefs 240 of the ring 24;
- the snap-fit forces flange 106 to come to rest on the axial bearing edge 38 of the upper end 4*a;*
- this action radially compresses the male conical bearing surface of the stopper member S (which is flexible), to conform to the female conical bearing surface defined by the inner face 104 of the upper end 4*a*.

With this type of conformation (with forced engagement), a very good seal is generated. Achieving a significantly high level of fluidtightness can be made possible by combining a rigid material and a flexible material that is able to adapt to the rigid material in order to closely follow its shape. For example, here it is the container 4 which is rigid, made for example of polypropylene, copolyester, or polyamide, and it is the stopper member S which is flexible, made for example of low density or medium density polyethylene. In some less-preferred variants, the materials can be reversed (the container 4 can be at least locally more flexible than the stopper member S).

In order to preserve the integrity of the two opposite conical bearing surfaces which provide the sealing, it is understood that the stopper member S and the container 4 facing it are advantageously of cylindrical symmetry. There is thus no deformation of the circularity at the connection to disrupt the uniformity of the bearing of the two conical bearing surfaces against one another. In practice, the axial annular contact at the axial bearing edge 38 does not in itself ensure the seal but serves to maintain a good level of radial compression at the conical bearing surfaces.

As is visible in FIGS. 1 and 2, the insertable closure portion 105 comprises an insertion portion IP of substantially cylindrical cross-section, between the flange 106 and a radial portion RP which is axially closer to the bottom 2*a*. The insertion portion IP of cylindrical cross-section is inserted through the upper end 4*a* of the container 4 (and typically through the opening 300 of the ring 24). The insertion portion IP is coaxial, around the longitudinal axis A of the pump 7, with the channel L formed centrally in the stopper member S in order to house and ensure fluidtightness around the metering pump 7. For this purpose, in addition to the annular contact area 27 in contact with the upper end 4*a* and as is clearly visible in FIG. 1, a radial sealing contact is provided between an annular lip 23 of the stopper member S and a bearing surface defined at the inlet 7*a* of the pump 7. The annular lip 23 is shaped for example by conical contact (for example the same principle as for the conical bearing surface at the upper end 4*a*) with the end of the pump 7 which defines the inlet 7*a*.

According to one option, an annular bead (not shown) is formed inside the channel L of the stopper member S, near its axial upper end. This bead engages on the body of the pump 7 near its flange 21, therefore at its most axially rigid location.

As illustrated in FIGS. 1 and 2, the stopper member S is protected at its flange 106 by the retaining part 26. The stopper member S and the retaining part 26 belong to a stationary portion of the metering assembly 15 which preferably provides a sufficiently strong attachment to the container 4 to withstand a drop test (corresponding to a drop of 1.5 m onto a hard surface as in the test specified in the ASTM D6344-04 (2009) document), without breaking any of the parts of the inner unit 25 and without compromising the operation of the metering pump 7 or causing any leakage of the seal.

Referring to FIGS. 1 and 7, it can be seen that the retaining part 26 is both able to axially retain the pump 7, for example by engaging with the flange 21 of the pump 7, and can define, by its lower portion 26*b*, an annular groove 26*g* which accommodates the peripheral portion of the stopper member S including the flange 106 as well as the upper end 4*a*. In the example shown, the retaining part 26 has an inner skirt 26*a* which, together with the outer skirt J formed in the lower portion 26*b*, defines the annular groove 26*g*.

A surface of the stopper member S, which serves to define an annular contact area 27 against an inner face of the container 4, at the upper end 4*a*, can extend inside this annular groove 26*g*. In other words, the sealing surface can be protected by locating it in such a groove 26*g*. After the sealed closure, the inner face 104 of the upper end 4*a* also extends into the groove 26*g* so that a protected sealed connection is obtained, created between the upper end 4*a* of the container 4 and the insertion portion IP extended by the flange 106, Here, the inner skirt 26*a* extends from the radial portion 26*f* which defines the cross-section transition, to an annular end placed lower than the annular contact area 27, More generally, it can be seen in FIG. 1 that the stopper member S defines, together with the retaining part 26, a narrow annular groove 50 (that is part of the head 6), into which the axial bearing edge 38 of the upper end 4*a* is inserted. The upper end 4*a* can be gripped in this annular groove 50, for example with a contact formed by the lower portion 26*b*. The upper end 4*a* of the container 4 can be inserted between the lower portion 26*b* and the insertion portion IP of the stopper member S.

Figure 6:
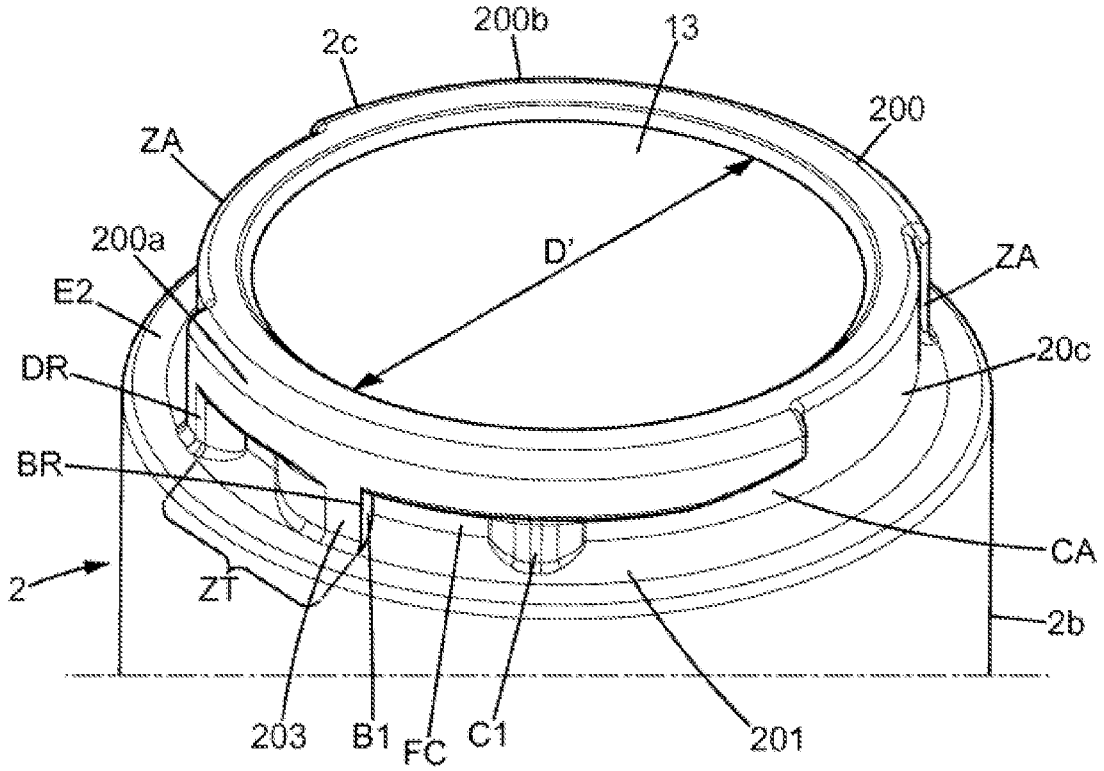
FIG. 6 is a perspective detail view showing the top of a bottle forming the body, in an embodiment of the invention identical to that of FIGS. 4 and 5.

In the case of FIGS. 1 and 6, it can be seen that the retaining part 26 is engaged with the pump 7, the collar 7*c* on the internal reliefs 261, 262 which may be defined by two pairs of lugs, A flange 26*c*, located on the portion which surrounds the end 4*a*, here engages between two lugs of the same pair, with axial locking. The outside diameter D5 defined at the flange can be greater than the diameter of the opening 300 and slightly greater than a dimension of the spacing between the lugs 240 of the ring 24 in order to be able to be housed in and snap into the ring 24 by elastic deformation.

Once the sealed closure has been obtained, the retaining ring 24 allows easily connecting together the reservoir portion R and the head 6 forming the metering tip. Here the ring 24 is mounted from below, as is visible in FIG. 2, and comes to be positioned, externally, at the same level as the container 4/stopper member S sealing area. Here, as illustrated in FIG. 1, it is preferable that the ring 24 alone performs the function of an axial stop for the container 4, for example by an inner rim RB or appropriate internal reliefs. The wall 4*b* comprises a collar, bead 400, or at least one relief (typically a projecting circumferential relief) to stop the ring 24 from sliding (downward or upward) along the container 4. To avoid structurally altering the upper relief of a pair of reliefs 240 of the ring 24 during assembly operations, the former may have a beveled upper face 240*a*. A beveled upper face may also be provided for the retaining relief(s) 262 (FIG. 7) which prevent the pump 7 from being withdrawn from the retaining part 26.

Due to the bearing of the container 4 (here by the collar/bead 400) on the inner rim RB of the ring 24 and due to the axial retention of the retaining part 26 by the reliefs 240, the container 4 cannot be accidentally disassembled from the head 6. Although FIGS. 1 and 2 show a continuous flange 26*c*, it is understood that such a flange can also have slits and be subdivided into discontinuous segments.

A container 4 with a circular cross-section is advantageous for obtaining satisfactory performance in the dynamic sealing at the piston 29 and in the static sealing at the interface between the lower reservoir portion R and the head 6 (dispensing upper portion).

As illustrated in FIGS. 1, 10, 12 and 13 in particular, the container 4 may be centered relative to the side wall 2*b* of the body 2, for example by matching size and shape between the container 4 and a neck 20*c* formed at the upper end of the body 2, optionally by choosing an outside diameter D4 of the container 4 which is more or less identical (for example identical or very slightly less) to the diameter D' of the opening 13, defined here at the upper edge 2*c* above the neck 20*c*. The retaining ring 24 can come to rest axially against the upper face of the edge 2*c*. Alternatively, any radially projecting annular relief or any arrangement with radial projections, formed on a periphery of the inner unit 25, may be suitable for forming a contact edge or rim against the upper end of the body 2, in order to stop the sliding of a lower reservoir portion R of the inner unit 25, when assembling the container in the body 2.

In the case illustrated in FIG. 1, the ring 24 is retained entirely outside the body 2, extending entirely above the plane of the opening 13. In alternatives, the retaining ring 24 may be partially inserted into the opening 13.

Referring to FIGS. 1 and 2, the retaining ring 24, of annular shape, extends around an opening 300 which can form an orifice for the passage of the container 4. An annular bead 400, a collar, and/or lugs formed on the outer face of the container 4, near the opening 13 of the body 2, come to rest on one or more rims RB forming an axial stop surface, which makes it possible to lock the container 4 in an insertion configuration in the body 2. The container 4 can thus be retained at a distance from the bottom 2*a* of the body 2 or at a predetermined relative distance from an annular lower edge of the body 2. In certain options, the annular bead 400 may be replaced by an additional part attached to the top of the container 4 or in the upper lateral area thereof. Additionally or alternatively, an operation of clipping the ring 24 directly or indirectly on the container 4 may optionally be provided.

In preferred embodiments, the configuration of the parts is arranged so that the container 4 is prevented from sinking into the body 2 during placement of the stopper member S (for example during forced insertion of the head 6, after filling). This is made possible here by the lower surface of the external bead 400 or similar protruding relief of the container 4 and the corresponding surface of the ring 24. It is understood that the ring 24 can provide moderate retention of the elements of the reservoir portion R as is shown at the bottom in FIG. 2 (with the container 4 kept integral with the body 2 during intermediate handling and transport operations, which is a temporary situation), while in the situation after final assembly by insertion of the head 6, the parts are inseparable, to form an inner unit 25 that cannot be disassembled.

Before closing the opening O, the container 4 may be suspended by means of the ring 24, with no axial support of the lower end 4*c* on the bottom 2*a* of the body. This allows great freedom in creating the shape of the bottom 2*a* of the body 2. With reference to FIG. 1, the container 4 is for example inserted from above and comes to rest axially on the annular inner rim RB formed in the inner surface S24 of the rind 24.

Once the dispensing head 6 is in place with the stopper member S engaged against the container 4, the ring 24 performs its retaining function by axially locking the engagement rims 400, 26*c* of the reservoir portion R and of the head 6. Here these engagement rims 400, 26*c* are respectively formed by the container 4 and the retaining part 26, as is clearly visible in FIG. 1. Typically, these engagement rims 400, 26*c* come to engage in a housing of the retaining ring 24, formed by an internal recess or between two reliefs 240 of the retaining ring 24 that are axially spaced apart from one another. Such a housing may be located in an intermediate axial position, and at a distance between a lower edge 24*a* of the outer face F24 of the ring, preferably cylindrical, and at least one upper edge 24*b* of this outer face F24, respectively.

As is clearly visible in FIGS. 1, 2 and 10 in particular, it is understood that the contact between the upper end 4*a* (with no ring gasket) of the container 4 and the head 9 (also with no ring gasket) is direct, without the use of an additional gasket.

In this non-limiting embodiment, one thus obtains, from the components visible in FIG. 2, a complete inner unit 25 of the type illustrated in FIG. 3. This inner unit 25 is of the non-disassembling type, Referring to FIGS. 1, 6, 8A, 8B and 10-11A, it is understood that the device has an outer side wall SW, here composed of a tubular outer portion 107 of the upper connector 17 and by the outer side face of the body 2. This outer side wall SW extends, around the longitudinal axis X, from the lower end of the body 2 to an annular upper edge 17*b*, 117*b* of the tubular outer portion 107.

The retaining ring 24 is covered by the outer side wall SW in an assembled state of the device 1. Preferably, the outer side wall SW is heterogeneous, for example with a first rigid material composing the body 2, for example in the form of a glass bottle, and a second rigid or semi-rigid material composing the tubular outer portion 107.

In FIG. 1, it can be seen that the outer portions 1*b* and 1*c* of the device 1 have continuity in their geometry and cross-section (substantially identical dimensions) in the area surrounding the dispensing head 6. The cap 16 typically forms a complementary portion 1*a* which also extends these outer portions 1*b* and 1*c*, with continuity in the geometry and cross-section. The upper connector 17, 117 is provided with one or more attachment members for the cap 16, preferably with such members placed in a tubular portion forming an upper sleeve 18, 118. With the cap 16 closed, this sleeve 18, 118 is not visible because it is narrower than the tubular outer portion 107 defining portion 1*b*, and housed in an internal volume of the cap 16.

Figure 8A:
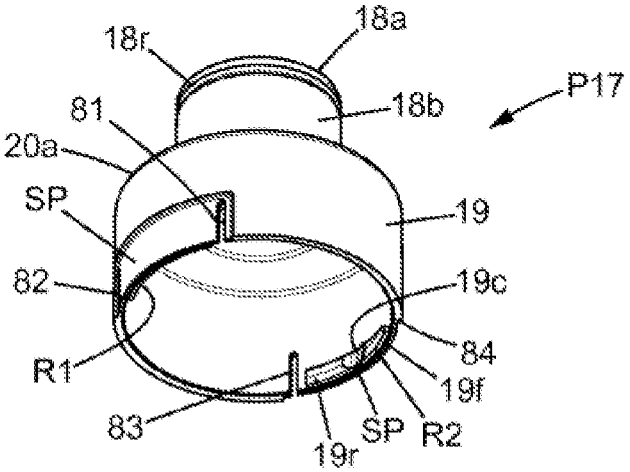
FIG. 8A shows a perspective view of an exemplary part constituting or belonging to the upper connector, including a skirt in which reliefs or lugs are formed internally for engaging with complementary means.
Figure 8B:
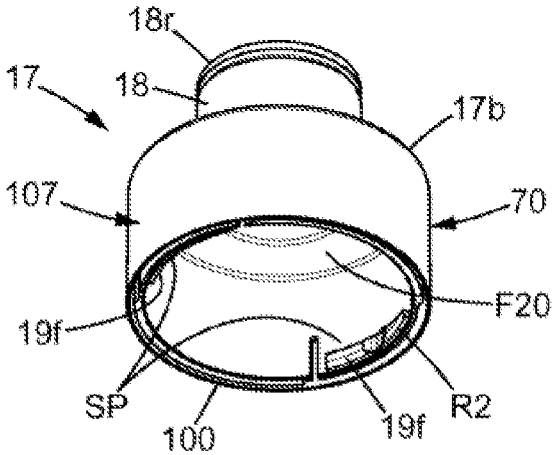
FIG. 8B shows a perspective view of an exemplary retention part usable in a stationary portion of the metering assembly and contributing, on the one hand, to an axial retention of the metering pump in a housing defined by the stopper member, and on the other hand to the bonding effect of the head against the reservoir portion, due to an external engagement rim engaged against the inside of the ring.
Figure 13:
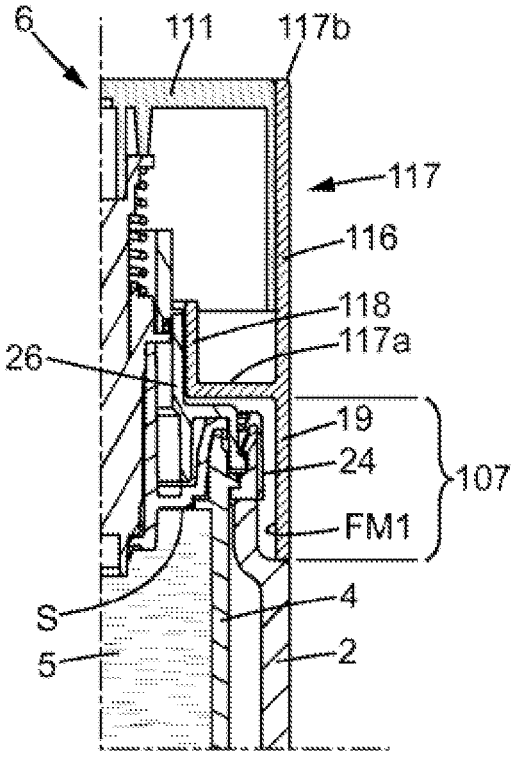
FIG. 13 is a detail view in axial section, illustrating an in-depth example of the device when the body is defined by a sleeve.
Figure 14:
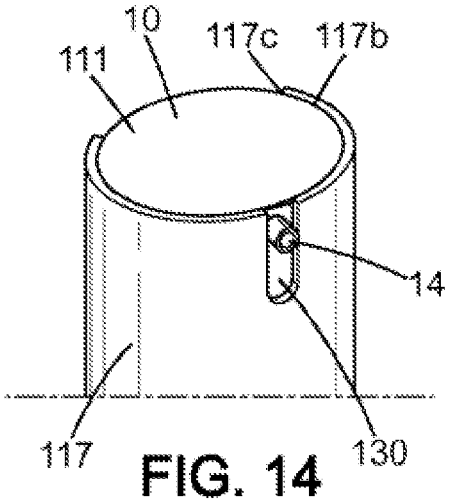
FIG. 14 is a perspective view of the top of a device for dispensing and packaging fluid, obtained with an upper connector of the type illustrated in FIG. 13.

Embodiments of an upper connector 17, 117 will now be presented, in conjunction with FIGS. 1, 8A and 8B, as well as FIGS. 13 and 14.

The connector 17, 117 has, from the base to the top;

the tubular outer portion 107 provided to surround the inner unit 25 in the area of the retaining ring 24;

a radial portion 20, 117*a* which extends around a channel for the passage of the metering pump 7; and the narrower channel, which may be in the form of an upper sleeve 18, 118 without any attachment to the dispensing head 6.

In the example of FIGS. 13 and 14, the connector 117 also has a coaxial upper section 116 around the sleeve 118 and which extends the tubular outer portion 107 upwards. In all cases, it is preferred that radial portion 20, 117*a* extends radially outwards beyond radial portion 26*f* in order to define, under radial portion 20, 117*a*, a cylindrical housing larger than diameter D5, which makes it possible to place the ring 24 radially between the lower portion 26*b* of the retaining part 26 and the connector 17, 117.

In the embodiment of FIGS. 1 to 3 and 8A-8B, as in the case of FIGS. 13-14, it can be seen that radial portion 20, 117*a* extends radially outwards from the sleeve 18, 118 to a tubular outer portion 107 including first attachment means FM1 serving to retain and lock the body 2 both axially and in a direction of rotation, by engaging with second attachment means FM2 provided on the body 2, typically in a portion covered by a skirt 19 of the connector 17, 117.

The upper connector 17 or 117 may comprise or consist of a part P17 which comprises the attachment means FM1, to enable removable attachment of the body 2 by a relative rotational movement between the connector 17, 117 and the body 2. For this purpose, the part P17, called the main part in the following, has the skirt 19 where the attachment means FM1 are formed. The skirt 19, of generally annular shape extending from radial portion 20 to a lower annular edge (visible in FIG. 1), has one or more flexible portions SP, here two flexible portions in the non-limiting case of FIGS. 8A-8B.

These flexible portions SP can be made flexible by thinning the skirt J19 and/or by a demarcation between two slots 81, 82, respectively 83, 84. This makes it possible to obtain a radial movement, in particular outwards, of these flexible portions SP during assembly on attachment areas of the body 2 which is more rigid than the main portion P17, and much more rigid than the flexible portions SP. Each flexible portion SP constitutes a tongue, defined between two vertical slots 81, 82 or 83, 84 and attached to the rest of the part P17 by a connection area representing less than 90° on the circumference of the skirt 19. The main part P17 is typically made of elastically deformable plastic.

Figure 9:
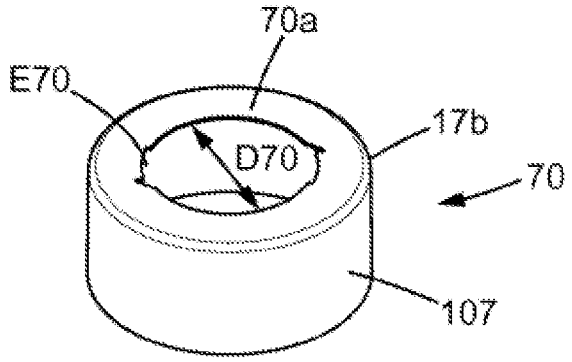
FIG. 9 shows a perspective view of an exemplary part forming a ferrule usable to cover the skirt, as in the case of FIG. 8B, including rotation-preventing shapes engaging with complementary reliefs of the part illustrated in FIG. 8A.

A part forming a ferrule 70 may cover the skirt 19 while being fixed to part P17 so as to be integral in rotation, about the longitudinal axis X, with this part P17. Referring to FIG. 9, part 70 may comprise an opening for the passage of the upper sleeve 18 formed by part P17, and a radial portion 70*a* bordering this axial opening and extending to a circular line of connection with a tubular outer portion 107 which laterally covers the skirt 19. Part 70 is a piece optionally made of metal, provided with an external metallic coating, or made of glass. As a non-limiting example, it may be made of aluminum.

Figure 11A:
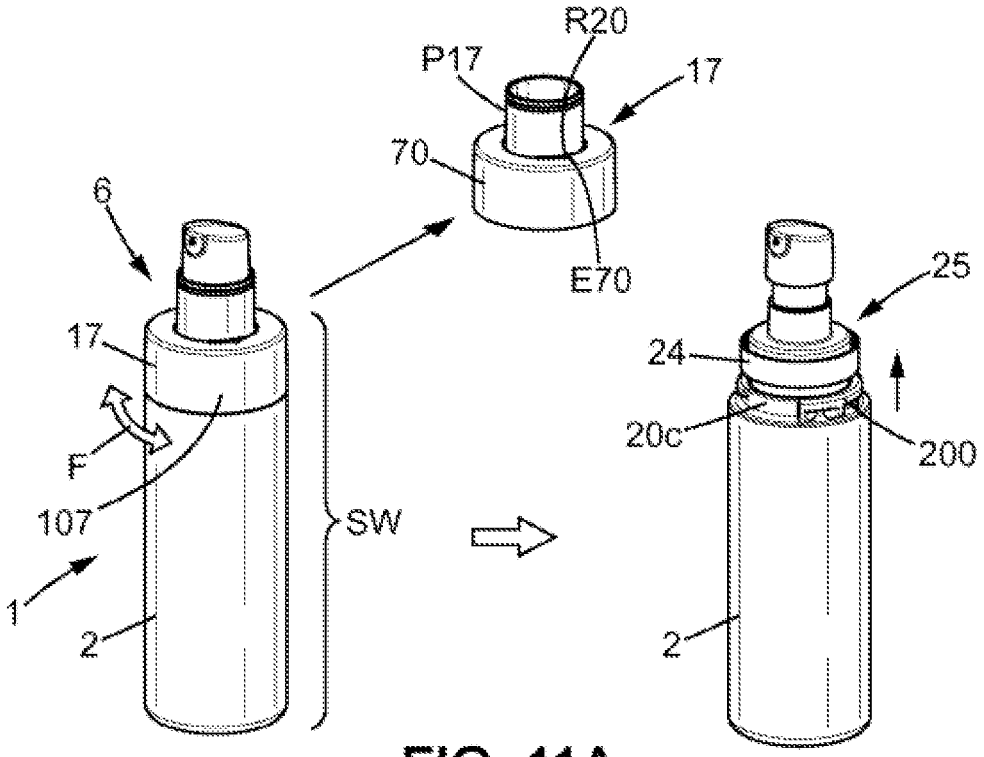
FIG. 11A illustrates an unlocking of the upper connector, allowing easy detachment and removal of the upper connector and then sliding extraction of the inner unit.

The diameter D70 of the axial opening is for example slightly greater than the outside diameter of the upper sleeve 18. As illustrated in FIG. 11A, one or more slots or notches E70 may be provided which locally widen the axial opening and which make it possible to insert one or more axial projections R20 formed on the radial portion 20 of part P17. By entering the notches E70, for example between the sleeve 18 and a non-circular edge defining the axial opening, the axial projections R20 prevent rotation of the part forming a ferrule 70 (auxiliary part without contact with the unit 25) relative to the main part P17. A position indicator function, for example in the form of an arrow indicating the direction of disassembly of the connector 17, may optionally be obtained by the cut notches E70 and/or by the shape of the axial projections R20 visible from above.

The upper connector 17 or 117 surrounds the stationary portion of the metering assembly 15 and also surrounds the push member 11, forming a channel called the upper sleeve 18, 118 in the following, where this push member 11 can slide. Alternatively, the push member 11 may cover the portion/upper sleeve 18, 118 of the upper connector 17, 117, at least when it is actuated to dispense the product 5. However, it may be advantageous that it is the push member 11 which slides inside the upper connector 17, 117, as in the case in FIG. 1 or FIG. 10, for example with a configuration which renders the push member 11 non-detachable (possibly by means of an annular bead, retaining ribs, or lugs for the push member 11). This last configuration is advantageous when wanting to be able to guarantee that the flow path for the product 5 will not be broken.

As shown in FIG. 1 in particular, the inner surface 18*c* of the sleeve 18, 118 allows the upper connector 17 to be positioned around the upper end portion 26*d*, and more generally around the metering assembly 15, before engagement of the upper connector 17 on the body 2. It is possible that the upper connector 17, 117 does not clamp the receiver assembly 26, S or the ring 24, so that a rotational force on the upper connector 17, 117 (relative rotation about the longitudinal axis X with respect to the reservoir portion 1*b*) will not be passed on to these internal parts.

The upper connector 17, 117 is for example positioned on the metering assembly 15 from above, by exerting a simple axial displacement, with no centering function. Indeed, the alignment between the container 4 and the head 6 can be achieved in the area of contact between the flared inner face 104 of the container 4 (typically forming a conical sealing surface) and the stopper member S. The configuration of the tip/head 6, in particular with the retaining part 26 which covers the stopper member S, makes it possible to free this area of contact from any parasitic stress that could affect the uniform distribution of the radial compression of the stopper member S on the conical bearing surface of the container 4 or other similar compression required to seal closed the opening O.

In practice, in the case of the non-limiting examples illustrated, the upper connector 17, 117 can then be rotated relative to the dispensing head 6, which makes it possible to position, where appropriate by rotation, the attachment means FM1 of this connector 17, 117 to be facing the access areas ZA (FIG. 4) having an angular demarcation (typically less than or equal to 90° or 100°) and allowing an annular lower end 100 of the connector 17, 117 to be placed below a lip 200 of the body, as will be described below. The placement of the annular lower end 100 under the lip 200 can be carried out at the same time as the axial contact/bearing engagement of radial portion 20, 117*a* on radial portion 26*f* of the retaining part 26.

In the example of FIGS. 8A and 8B, it can be seen that the upper connector 17, tubular with a cross-section transition made possible by radial portion 20, has a peripheral portion which extends longitudinally and annularly from the outer edge 20*a* of the radial portion 20, forming a skirt 19 with flexible portion(s). As will be seen below, a flexibility enabling radial movement of the skirt 19 of the connector 17, 117 can be advantageous to allow rotational coupling with locking, on an attachment area of a rigid body 2.

In a preferred embodiment, the outer side wall SW is obtained by a rotational coupling between an external upper portion of the body 2 and a lower inner portion of the upper connector 17, 117, typically provided in the skirt 19 (preferably by selective use of flexible portions SP to move across provided rigid reliefs that project, relative to a bottom surface FC, on the outer face of the body 2).

Figure 4:
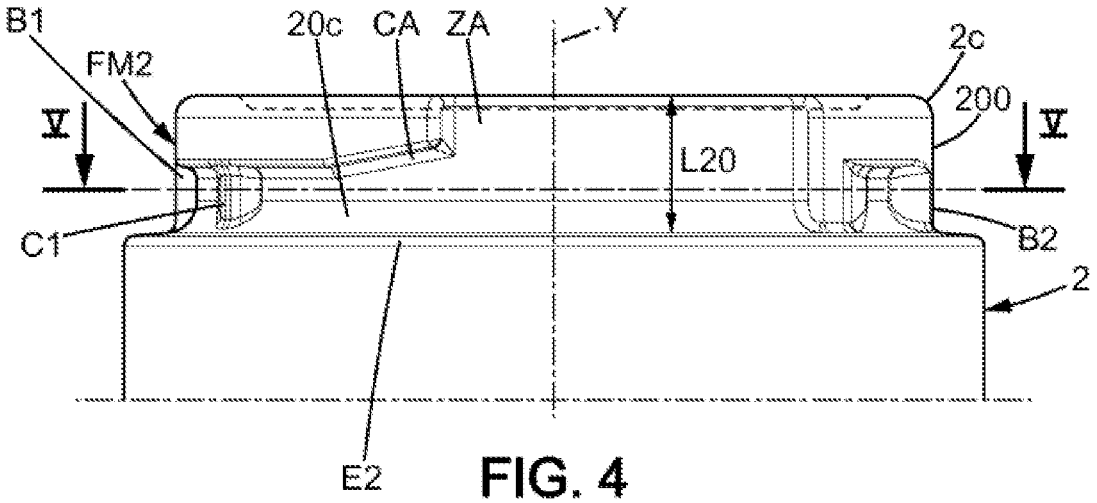
FIG. 4 is a side view detailing the top of an external covering body suitable for protecting the bottom of the inner unit and then enabling the attachment and locking of the upper connector of the device.
Figure 5:
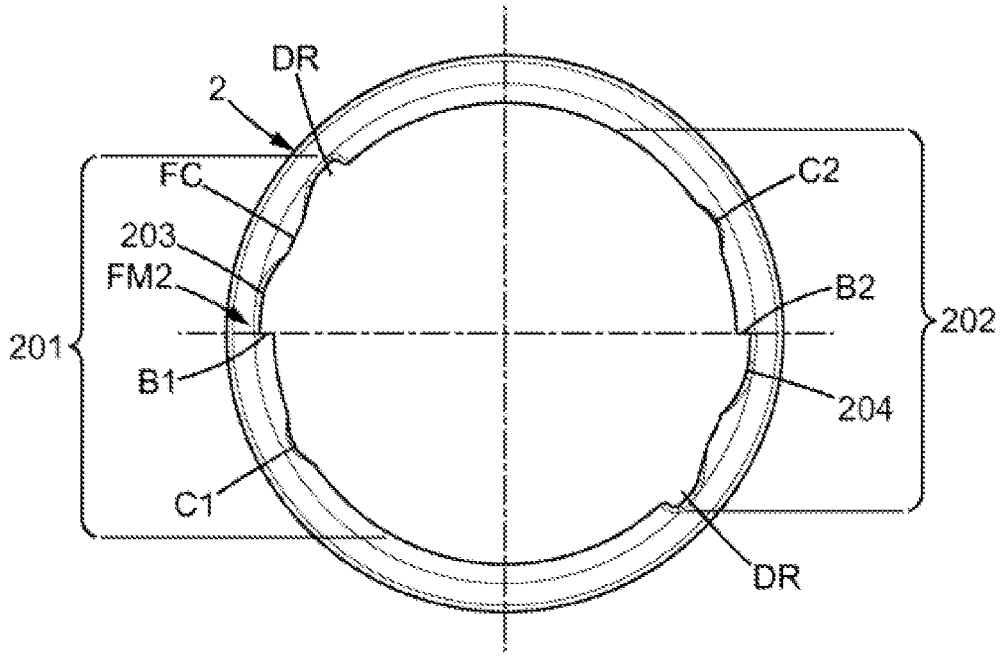
FIG. 5 is a section view along section plane V-V of FIG. 4, illustrating means for a removable attachment of the quarter-turn type with pre-tightening and end-of-travel locking.

Referring now to FIGS. 4, 5, and 6, one can see an embodiment of a bottle forming the outer body 2, in which there are provided receiving means FM2 for a bayonet-type connection. Connection means FM1, complementary to means FM2, are provided in the upper connector 17, 117, here at an inner side face. This makes it possible to configure the body 2, composed of the bottle and the upper connector 17, with external covering surfaces for the device 1, of which the circumference is of the same shape, so as to have continuity in the external cross-section from the base to the top of the outside face of the device 1 (where appropriate with gradual transitions in the cross-section, for example on the bottle).

More generally, a body 2 made as one piece may be preferred to define both the outer portion 1*c* of the outer side wall SW and the attachment area including the receiving means FM2 for the bayonet-type connection. The bottle forming this body is preferably made of glass.

The bottle (or body 2) is rotationally symmetrical about a longitudinal axis Y which is typically coincident with the longitudinal axis X of the container 4 in the mounted state of the device 1. The bottle has for example a lip 200 or similar rim portion formed in a neck 20*c* which comprises the upper annular edge 2*c* of the body 2. The axial extension L20 of the neck 20*c* may advantageously be small. A relatively small axial extension makes it possible to reduce the area of overlap between the body and the upper connector 17 or 117, and thus to minimize the plastic required in the design of the upper connector 17, 117, in particular by reducing the length of the skirt 19 (see FIG. 8A) and, where appropriate, reducing the extension of the part forming a ferrule 70 (see FIG. 9).

As a non-limiting example, the neck 20*c* has a total height or axial extension L20, measured from the shoulder E2, that is less than or equal to 15 mm. The second attachment means FM2 extend over this neck 20*c*, in particular with retaining reliefs provided on a side surface portion of the neck 20*c*, in a position adjacent to the shoulder E2 of the bottle. The shoulder E2 extends transversely from the neck to join the top of the outer portion 1*c* (upper end of the wall 2*b*).

Referring to FIG. 6, the lip 200 is discontinuous with notches forming axial passages or access areas ZA, distributed over the circumference, to allow the internal lugs R1, R2 of the upper connector 17, 117 to descend to the shoulder E2 (initial low axial position of the internal lugs R1, R2). From such a low axial position of the connector, all that remains is to rotate the upper connector 17, 117 (here in the clockwise direction, without this being limiting) with respect to the body 2 or conversely the body 2 in the opposite direction of rotation, with respect to the upper connector 17, 117.

The rotation is preferably of the type representing substantially a quarter of a turn (plus or minus 10°). The lip portions, separated by the access areas, may be two in number, representing an angular sector comprised between 80 and 105°, for example about 95° (the access area ZA can then represent a sector angle comprised between 75 and 100°, for example approximately 85° in the non-limiting example of FIGS. 4 to 6).

The bottle or body 2 may be designed with reliefs and a demarcation of lateral cavities 201, 202, in order to obtain pre-clamping and then end-of-travel locking, during the pivoting of the skirt 19.

To keep the upper connector 17, 117 integral with the body 2, an inside assembly face is provided on the inner side of the skirt 19. The inside assembly face is connected to the annular edge 2*c* of the body 2 by internal lugs R1, R2 which catch under the radial projections or under the lip 200 of this annular edge 2*c*.

In the embodiments of FIGS. 1, 5-6, 8A-8B and 10, it can be seen that the neck 20*c* comprises at least one lateral cavity 201, 202 for receiving a corresponding internal lug R1, R2 which is part of the second attachment means FM2. The cavity 201, visible in FIG. 6, is defined axially between a portion 200*a*, 200*b* of the lip 200 and the shoulder E2, and extends circumferentially between a termination zone ZT and an access channel CA of narrowing cross-section as it approaches the retaining reliefs. The termination zone ZT may be elongated and/or comprise a stop surface B1, B2 having a radially outer edge BR, such a stop surface B1, B2 being formed in a protruding projection 203, 204.

One or more projections 203, 204 are provided in each termination zone ZT, such that each lateral cavity 201, 202 can function as a guide into which the tangential sliding grows increasingly hard, until it stops with engagement of a so-called front end 19*f* (leading or proximal end) of an internal lug R1, R2 against the stop surface B1, B2. In the example illustrated, two diametrically opposed internal lugs R1, R2 thus engage with two diametrically opposed stop surfaces B1, B2 of the body 2, for a position where the neck 20*c* is covered by the skirt 19.

It is possible to use protruding reliefs in the termination zone ZT, in order to push at least the front end 19*f* of the internal lugs radially outward, At the end of travel or just before and at the moment the locked configuration is obtained, the flexible portion or portions SP of the skirt 19 move apart radially outward because each of the internal lugs R1, R2 then covers the termination zone where the projection 203, 204 extends. In the example illustrated, each flexible portion SP folds slightly inwards, radially, at the end of travel, because each projection 203, 204 enters an intermediate recess 19*c* present in the internal lug R1, R2. Further behind this intermediate recess 19*c* (in a distal position) of the internal lug R1, R2, there is a rear or distal end 19*r* which may extend, in the locked configuration, between the projection 203, 204 (abutting against the corresponding stop surface B1, B2) and a protruding catch C1, C2. The projection 203, 204 and the catch C1, C2 oppose an accidental disengagement of the internal lug R1, R2 but can be overcome with sufficient rotational actuation force, due to the elasticity of the flexible part SP.

In FIG. 6, one can thus see for the lateral cavity 201, between the access channel CA with narrowing cross-section (here narrowing axially) and an end-of-travel region optionally defined by a last relief DR, the presence of a catch C1 then a projection 203 defining a stop surface oriented towards the catch C1. The same configuration is typically used in the other lateral cavity 202, with a catch C2 which precedes a projection 204 similar to projection 203 (see FIG. 5).

Each catch C1, C2 here has a height, measured from the bottom surface FC, which is less than the depth of the lateral cavity, measured between the radially outer edge BR of the stop surface B1, B2 and the bottom surface FC. In addition, the catch C1, C2 corresponds to a progressive swelling or bulging formed on the bottom surface FC, while the stop surface B1, B2 can have an angle of about 90° relative to the bottom surface FC, as shown in FIG. 5.

More generally, the locked configuration can be obtained when each internal lug R1, R2, of elongated shape along a circumferential direction, is placed in a corresponding lateral cavity 201, 202, by extending on either side of a stop surface B1, B2 of the lateral cavity 201, 202, preferably by being inserted into the lateral cavity 201, 202 beyond a catch C1, C2 of said lateral cavity.

The upper connector 17, 117 can thus be integrally secured to the body 2, in the locked state of the bayonet-type connection. The upper connector 17 thus remains integral with the body 2 during use of the device 1, This makes it possible to use this upper connector 17 as a support for a cap 16. In addition, the skirt 19 of the upper connector 17, typically covered by the part forming a ferrule 70 which is rotationally integral with the skirt 19, can axially extend the outer face of the body 2 with a perimeter of identical size and length (with continuity of surface).

In the example of FIG. 1, the upper connector 17, which extends under the actuating portion 10, may also correspond to a ferrule in an intermediate position between the body 2 and the cap 16. In this non-limiting example, the upper connector 17 has a function of covering the upper portion of the device 1 in combination with the cap 16.

An example of disassembling the device 1 will be described with reference to FIGS. 6, 8A-8B, 9, 11A and 11B.

FIG. 11A shows the operation of decoupling, by a relative rotational movement illustrated by the arrow F to rotate the upper connector 17 and allow the internal lugs 11, 12, typically provided in flexible portions SP, to move across the reliefs B1, B2, C1, C2 in the opposite direction to the locking path. By a quarter-turn movement, for example, the skirt 19 can be disengaged from the connector 17 of the neck 20*c*, then the connector 17 can be axially displaced to remove it when the internal lugs R1, R2 are no longer under portions 200*a*, 200*b* of the lip 200. The projections R20 of the connector 17 and/or similar rotation-preventing reliefs (for example notches 70) may possibly indicate the direction of rotation of the connector 17 for disassembly. Any other indicators may optionally be used. It is understood that the connector 17 functionally forms a primary cover, the optional cap 16 constituting a secondary cover which is detachably mounted on the primary cover.

The inner unit 25 can then be withdrawn from the body 2 by simple axial extraction. When a cap 16 is provided, it may remain mounted on the upper connector 17 or be removed (which can allow a better handgrip on the tubular portion 107 to be rotated).

The retaining ring 24 here has a cylindrical outer face F24, its outer surface preferably smooth, so that any retaining effect by the body 2 is eliminated. The ring 24 may be placed entirely above the body 2, so that gripping the inner unit 25 (by gripping the ring 24) can be facilitated. Of course, the body can be removed to uncover the reservoir portion PR before removing the connector 17, it being understood that the body 2 and the connector 17 are detachable by moving them in opposite directions for an unlocked configuration of the upper connector 17.

Figure 11B:
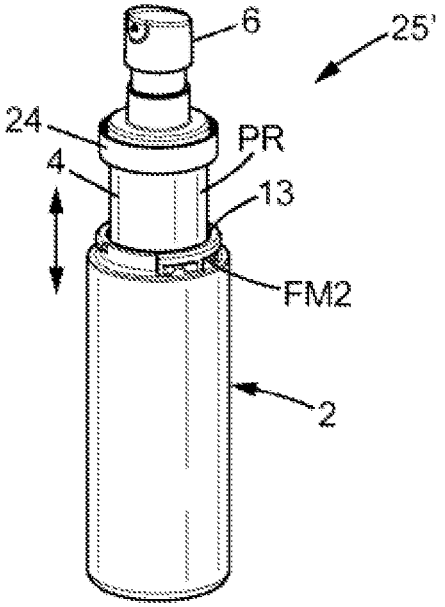
FIG. 11B illustrates the sliding insertion of a new inner unit to replace the inner unit of FIG. 11A, which allows reusing other portions of the device.

As shown in FIG. 11B, after discarding the inner unit 25 (expendable) already used/consumed, it is sufficient to insert the reservoir portion R of a new inner unit 25' into the body and return the upper connector 2 to the locked attachment position, reusing the respective connection means FM1 and FM2. This protects the new cartridge 25' which is no longer visible except for the movable portion of the metering device 15.

With this type of construction, a user can procure the device 1 including its inner unit 25 and, at the same time, inner units 25' forming compatible cartridges or refills to be inserted internally between the body 2 and the upper connector 17, 117. The fluidtightness of all the inner units is obtained in an identical manner, so that the inner units 25, 25' can be stored for a long time without altering the product 5 (fluid or viscous content).

Referring to FIGS. 13 and 14, an alternative embodiment is described with a body 2 identical or similar to that of the preceding figures, onto which is removably attached an upper connector 117 of which the tubular outer portion 107 serving to form the upper portion of the outer side wall SW is composed of:

- a lower section which joins to the radial portion 117*a* of the upper connector 117, surrounding the ring 24 and extending downwards to an area of contact with or adjacent to the shoulder E2 of the body 2; and
- an upper section 116 which extends the lower section upwards (from the area of the join with the radial portion 117*a*) to an upper edge 117*b* which surrounds the actuation zone, the push member 111 of the dispensing head 6 extending into the hollow defined by this upper section.

We can see here a mounting of the push member 11 which allows retention of the body 2 by a more elongated external covering part, which extends around the metering assembly 15. The upper connector 117 also has an upper sleeve 118 similar to sleeve 18 of connector 17 of the embodiments shown in particular in FIGS. 8A-8B. Such an upper connector 117 has many similarities with upper connector 17 provided in the embodiment of the preceding figures, and differs essentially in that the upper section 116 extends the outer face upwards to an end forming the edge 117*b* which surrounds the actuating portion 10, so that a cap 16 is not necessary. Furthermore, it may be provided that the actuating portion 10 can also be withdrawn. For example, before disassembly, the actuating portion 10 may be retained from above by one or more inside projection portions or a rim provided at the upper edge 117*b* and mounted on the movable portion of the pump 7 with no retaining relief, which makes it possible to separate the inner unit 25 from the connector 117/actuating portion 10 assembly. Indeed, by raising the connector 117 while firmly holding the reservoir portion R of the unit 25, the actuating portion 10 is detached from the rod 11*a* without significant effort.

Possibly, in some variants, an unscrewing or similar disconnection (optionally by a bayonet-type connection) of the inner unit 25 may be performed after extraction from the body 2, in order to detach the push member 111 from the rest of the dispensing head 6 which is part of the inner unit 25. The distribution member 14, laterally integrated into the push member 111, forms a rotation-preventing projection through a slot 130 to prevent any relative rotation between the upper connector 117 and the push member 111.

The ring 24 provided in the device with upper connector 117 of FIGS. 13 and 14 may be identical or very similar to that of the previous figures. It is understood that the head 6 here has a push member 111 which can be mounted internally in an upper compartment defined by the tubular upper section 116. The transverse wall forming the radial portion 117*a* separates this upper compartment and a lower compartment within which the top of the reservoir portion R comes to be housed. The upper compartment is open axially and a transverse surface, here flat, of the push member 11 is clearly visible, being flush with or slightly recessed relative to the level of the end 117*b*, in the non-actuated position. Actuation of the push member 111 can be facilitated by a notch 117*c* formed in the upper end 117*b* of the upper connector 117 (FIG. 14), This is ergonomic, making it possible to increase the area of contact between a user's finger and the push member 111.

A slot 130, here opposite to the notch 117*c*, can allow the outlet of the distribution member 14 to project radially outwards beyond the outer face defined by the upper section 116, or flush with this face. Although FIG. 14 shows a slot 130 which is open at its upper end, such a slot 130 may also be placed differently, with no open end. The slot 130 is vertical here and makes it possible to guide the sliding of the push member 111 with no possibility of significant rotation.

It is understood that the body 2, the upper connector 117, and optionally the push member 111, can be reused with a new inner unit, after the disassembly/assembly operations (the principle illustrated in the diagram of FIGS. 11A-11B remaining applicable).

Referring to FIG. 12, in the preferred case of a container 4 of circular cross-section, the fill opening O has a diameter D2 which may be substantially identical to the inside diameter D1 of the container 4 at its lower end 4*c*, possibly less than D1, and preferably at least equal to 90%, or even 98% or 100% of D1. The use of a container 4 without a neck makes it possible to avoid slowing down the filling operation. The diameter of the fill opening O is typically greater than 15 mm and generally exceeds half of diameter D or a characteristic representative of the outer perimeter of the body 2 at least near the shoulder E2, More generally, the fill opening O can have a diameter at least equal to 75% of the diameter of the opening 300 of the ring 24.

The body 2 is made as one piece. The side wall 2*b* of the body 2, tubular, may have a constant cross-section as in the case of FIG. 12 or may comprise at least one bulge 60 in an intermediate portion as in the case of FIG. 10. The shape of the cross-section may also vary (for example with an oval cross-section only at a bulge). More generally, the body 2 can have any type of geometry with a circumference suitable for gripping and which exceeds the maximum circumference of the container 4, so as to avoid any radial contact between the container 4 and the side wall 2*b*, except for the area located above the shoulder E2 of the body 2. It is also understood that the ring 24 is located above the upper opening 13 of the body 2, without interfering with the fill opening O.

The device 1 can be compact and is well-suited for dispensing the same precise doses of liquid or viscous product. The device 1 is typically in the form of a bottle with a metering head/metering tip and is designed in particular for cosmetic and other applications requiring a high degree of customization of the outer side wall SW.

The device 1 is particularly accommodating of an airless metering pump 7, which reduces the risk of contamination while allowing almost completely emptying the product 5. Between the dispensing channel 8 of the pump 7 and the interior of the container 4, no exposure to air is possible, the ring 24 ensuring that a seal is maintained. It is also understood that the device 1 has a very limited number of moving or flexible parts, so that it is particularly robust and remains effective after a large number of uses. The integrity around the container 4 and the pump 7 is maintained despite any impacts, which allows ensuring the seal.

In the examples illustrated, it is understood that the container 4 and the dispensing head 6 can form an integral sub-assembly, in the form of a pre-assembled unit, which can be installed (as one piece) between a body 2 having a protective and covering function and an upper connector, typically a rigid body 2 and connector provided with one or more flexible portions integrating reliefs or rotationally coupling lugs on the upper attachment area of the body. The user can therefore easily remove the inner unit, as shown in FIG. 11A, from the sub-assembly forming the outer side wall SW, in order to reload the device 1 (replacing the empty cartridge composed of the inner unit 25, by a full cartridge). This makes it possible to reuse the upper connector 17, 117 and the body 2 multiple times, these reusable parts possibly being finely detailed and relatively costly, and thus to extend their service life beyond the period of use of the product 5 contained in the container 4 of the inner unit 25.

For the consumer, it is easier to keep these parts including the bottle forming the body 2, rather than having to return the bottle to the seller in order to possibly benefit from a discount or an advantage in a later purchase of another device.

It should be obvious to those skilled in the art that the invention allows embodiments in many other specific forms without departing from the scope of the invention as claimed.

Thus, although the figures show a container 4 implemented in two parts to facilitate insertion of a piston 29, it is also possible to insert into the body 2 a container with a movable bottom. Also, the retaining part 26 may be replaced by an equivalent assembly of at least two parts having both an effect of axial thrust on the stopper member S and of retaining the metering pump 7. In some options, the inner unit 25 may have another kind of metering assembly 15, possibly with an air inlet, for example in options with filtration of the incoming air which can circulate (in the form of filtered air where appropriate) to inside the reservoir.

Furthermore, the inner unit 25 may optionally have a linear guiding relief along the body, for example on the ring 24, and/or any rotational indexing means, for example a pin or an orifice for a pin, may be provided in a portion of the body 2 in contact with the container 4 or the ring 24.

The invention claimed is:

1. A device for packaging and dispensing a fluid product, the device comprising:

a body which is hollow and provided with a bottom or a lower edge at a lower end of the body;

a reservoir portion which comprises a container defining an internal volume of the reservoir and extending into an inside volume defined by the body, the container having a longitudinal axis and an opening at an axial upper end of tubular shape;

a head which comprises a metering assembly of airless type and a stopper member closing off the opening, the metering assembly comprising a metering pump and a movable actuating portion to enable dispensing the fluid product; and an upper connector onto which the body is fixed in a locked configuration of the upper connector, the upper connector having a radial portion which extends radially outward, around a channel for the passage of the metering pump, to a tubular outer portion;

wherein the device has an outer side wall extending around the longitudinal axis, from the lower end of the body to an annular upper edge of the tubular outer portion, wherein the device further comprises a retaining ring, which is:

in contact with the body and mounted to be axially movable relative to the body in unlocked configuration of the upper connector;

designed and arranged to lock axially together the reservoir portion and the head regardless of whether or not the upper connector is in the locked configuration; and engaged on engagement rims distributed over an outer face of the container and on the head, such that the head, the reservoir portion, and the retaining ring constitute a preassembled inner unit of the device, the retaining ring being covered by the outer side wall in an assembled state of the device, and wherein:

the body, comprises an upper attachment end which, in said assembled state and for the locking configuration, is axially engaged with an attachment area provided in the tubular outer portion, the attachment area and the upper attachment end forming a removable connection between the upper connector and the body, and in the locking configuration making it possible to keep the inner unit bearing axially against a lower inner face of the radial portion; and the upper connector is integrally secured to the upper attachment end by a locking action which takes place by a pivoting, about the longitudinal axis, of one among the upper connector and the body relative to the other.

2. The device according to claim 1, wherein the retaining ring is made as one piece and is in only axial contact with the body, from above.

3. The device according to claim 1, wherein the retaining ring bears axially against an upper annular edge of the body, where an upper opening of the body is defined, of circular cross-section.

4. The device according to claim 1, wherein the tubular outer portion forms an annular upper end of the outer side wall, wherein the outer side wall is under the form of a sub-assembly that is reusable, and wherein the outer side wall is heterogeneous, with glass as a first rigid material composing the body, and a second rigid material composing the tubular outer portion.

5. The device according to claim 1, wherein the retaining ring has a cylindrical outer face, the engagement rims distributed over the outer face of the container and on the head engaging in a housing of the retaining ring, formed by an internal recess or between two reliefs of the retaining ring that are spaced axially apart from each other, the housing being located in an intermediate axial position, and at a distance, respectively between a lower edge of the cylindrical outer face and at least one upper edge of the cylindrical outer face.

6. The device according to claim 1, wherein the attachment area and the upper attachment end form a bayonet-type connection system.

7. The device according to claim 6, wherein the upper connector has at least two internal lugs, acting to establish a bayonet connection, wherein the upper connector further has:

an outer skirt comprising at least one flexible portion, and wherein all or part of the attachment area is located in the at least one flexible portion.

8. The device according to claim 7, wherein the upper connector has a part forming a ferrule, laterally surrounding the outer skirt of the upper connector, and wherein at least one rotation-preventing relief is provided externally on the upper connector, in order to prevent relative rotation between the part forming a ferrule and the upper connector, about the longitudinal axis.

9. The device according to claim 1, wherein the radial portion of the upper connector is a transition portion between:

an upper sleeve radially proximal to the metering pump;

and the tubular outer portion radially distal to the metering pump, the upper sleeve and the tubular outer portion extending away from the radial portion in respective opposite axial directions, parallel to the longitudinal axis.

10. The device according to claim 1, wherein the body is a bottle of the type with a lip, made as one piece, the upper attachment end including means for attachment on a side surface portion of a neck, adjacent to a shoulder of the bottle, wherein the bottle, made of glass, has at least one lateral cavity for receiving an internal lug comprised in the upper attachment end, each lateral cavity of the at least one lateral cavity being defined axially between a portion of the lip (200) and the shoulder, and extending circumferentially between a termination zone, where a stop surface is formed having a radially outer edge (BR), and an access channel of narrowing cross-section.

11. The device according to claim 10, wherein there exists in each lateral cavity at least one relief protruding relative to a bottom surface of the lateral cavity, of which a relief constitutes a catch whose height, measured from the bottom surface, is less than cavity depth measured between the radially outer edge of the stop surface and the bottom surface, each relief of the at least one reliefs being designed and arranged to oppose the unlocking of the removable attachment between the upper connector and the body, the locked configuration being obtained when each internal lug is placed in a corresponding lateral cavity, extending on either side of the stop surface of the lateral cavity, beyond the catch.

12. The device according to claim 11, wherein the upper connector has at least two internal lugs which are each of elongated shape along a circumferential direction between a front end and a rear end, and each have an intermediate recess between the front end and the rear end, in order to receive, in the locked configuration, a projection formed integrally with the bottle, which is located in the lateral cavity and which allows constituting the stop surface.

13. The device according to claim 1, wherein the retaining ring is free to rotate about the longitudinal axis, such that during insertion of the reservoir portion into the body and in a fully inserted state of the reservoir portion in which the retaining ring bears axially against a stop surface of the body perpendicular to the longitudinal axis, the inner unit is free to rotate.

14. The device according to claim 1, wherein the retaining ring provides a rotational indexing relative to the body, such that the inner unit is rotationally locked when the reservoir portion is in a fully inserted state in which the retaining ring bears axially against a stop surface of the body which is perpendicular to the longitudinal axis.

15. A kit for packaging and dispensing at least one fluid product, comprising:

said device for packaging and dispensing as claimed in claim 1, the inner unit (constituting a first cartridge filled with a first product; and a second cartridge filled with a second product, the second cartridge being composed of another inner unit identical to the inner unit of the first cartridge, wherein the retaining ring of each inner unit forms an external collar arranged to extend outwardly relative to the container;

and wherein the body and the upper connector, separable by a movement in opposite directions for an unlocked configuration of the upper connector, make it possible to protect a given cartridge chosen indiscriminately among the first cartridge and the second cartridge, after insertion of the container of the given cartridge into the body and peripherally surrounding the metering portion of the given cartridge by the upper connector, and for a locked attachment configuration between the upper connector and the body, by using removable attachment means composed of the attachment area and the upper attachment end.

16. The device according to claim 4, wherein the container is suspended with the ring maintained above an upper annular edge of the body, with no axial support of a container lower end on the bottom at the lower end of the body.

17. The device of claim 12, wherein the front end is tapered.

* * * * *